US011206937B2

(12) United States Patent
Alletto, Jr.

(10) Patent No.: US 11,206,937 B2
(45) **Date of Patent: *Dec. 28, 2021**

(54) BED SHEETS WITH PERFORMANCE FABRIC

(71) Applicant: BEDGEAR LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 413 days.

This patent is subject to a terminal disclaimer.

(21) Appl. No.: 15/616,284

(22) Filed: Jun. 7, 2017

(65) Prior Publication Data

US 2017/0354276 A1 Dec. 14, 2017

Related U.S. Application Data

(60) Provisional application No. 62/347,189, filed on Jun. 8, 2016.

(51) Int. Cl.
*A47G 9/02* (2006.01)
*A47G 9/04* (2006.01)

(52) U.S. Cl.
CPC ..... *A47G 9/0246* (2013.01); *A47G 9/04* (2013.01)

(58) Field of Classification Search
None
See application file for complete search history.

(56) References Cited

U.S. PATENT DOCUMENTS 2,162,755 A * 6/1939 Shauer ..... A47G 9/0246 38/140
2,857,643 A * 10/1958 Tomsic ..... A47G 9/0246 24/301
2,942,280 A * 6/1960 May, Jr. ..... A47G 9/0246 5/497
4,045,833 A * 9/1977 Mesek ..... A61F 5/485 5/484
4,623,571 A * 11/1986 Yamamoto ..... A47C 27/15 428/68

(Continued)

OTHER PUBLICATIONS

International Search Report and the Written Opinion of the International Searching Authority—International application No. PCT/US2017/036150 prepared by ISA European Patent Office, P.B. 5818 Patentlaan 2, NL-2280 HV Rijswijk, dated Sep. 6, 2017 (Jun. 9, 2017).

*Primary Examiner* — Myles A Throop
(74) *Attorney, Agent, or Firm* — Sorell, Lenna & Schmidt, LLP

(57) ABSTRACT

A bed sheet is provided that includes top, side and end panels. Adjacent ends of the side and end panels are joined to form a seam at a corner of the sheet. The side and end panels each have a lower edge that is spaced apart from the top panel. At least one of the corners includes a power band having a first side that extends from a portion of the lower edge of one of the end panels to one of the seams. A second side of the power band extends from a portion of the lower edge of one of the side panels to the one of the seams. A third side of the power band extends from the portion of the lower edge of the one of the end panels to the portion of the lower edge of the one of the side panels.

22 Claims, 17 Drawing Sheets

(56) References Cited

U.S. PATENT DOCUMENTS 4,662,013 A * 5/1987 Harrison ..... A47G 9/0246 5/497
4,809,375 A * 3/1989 Bull ..... A47C 21/048 5/722
4,937,904 A * 7/1990 Ross ..... A47C 21/022 24/72.5
4,962,546 A * 10/1990 Vitale ..... A47C 31/105 5/497
5,029,353 A * 7/1991 Kimball ..... A47G 9/0246 5/497
5,046,207 A * 9/1991 Chamberlain ..... A47G 9/0246 5/496
5,217,780 A * 6/1993 Wurzer ..... A47G 9/0238 139/420 R
5,226,384 A * 7/1993 Jordan ..... A47C 27/00 119/28.5
5,249,322 A * 10/1993 Seago ..... A47G 9/0246 112/163
5,257,982 A * 11/1993 Cohen ..... A61F 13/5116 604/358
5,388,296 A * 2/1995 Mansour ..... A47C 21/046 5/484
5,479,664 A * 1/1996 Hollander ..... A47G 9/0246 5/497
5,530,978 A * 7/1996 Johenning ..... A47C 27/085 5/669
5,536,264 A * 7/1996 Hsueh ..... A61F 13/532 604/365
5,966,759 A * 10/1999 Sanders ..... A47C 27/007 5/497
7,120,952 B1 * 10/2006 Bass ..... A47C 27/006 5/484
7,370,380 B2 * 5/2008 DeFranks ..... A47C 27/00 5/483
8,480,097 B1 * 7/2013 Judge ..... B25H 5/00 280/32.6
9,492,023 B2 * 11/2016 Paulat ..... A47G 9/062
9,788,661 B1 * 10/2017 Alletto ..... A47C 21/046
9,795,231 B2 * 10/2017 Smith ..... A47G 9/0246
2002/0010448 A1 * 1/2002 Yoshimasa ..... A61F 13/53747 604/378
2005/0011007 A1 * 1/2005 Lintner ..... A47G 9/0246 5/497
2008/0294135 A1 * 11/2008 Hara ..... A61F 13/15203 604/367
2009/0019825 A1 * 1/2009 Skirius ..... B01D 39/18 55/521
2009/0070939 A1 * 3/2009 Hann ..... A61G 7/057 5/652.1
2009/0106899 A1 * 4/2009 Wootten, Jr. ..... A47G 9/0246 5/497
2011/0023234 A1 * 2/2011 Bolish ..... A47G 9/02 5/496
2012/0073049 A1 * 3/2012 Walker ..... A47G 9/0246 5/500
2012/0227185 A1 * 9/2012 Batiste ..... A47G 9/0238 5/641
2012/0260422 A1 * 10/2012 Rock ..... A47G 9/0223 5/483
2012/0284918 A1 * 11/2012 Gazagnes ..... A61G 7/05738 5/421
2013/0000043 A1 * 1/2013 Bullard ..... A47C 27/064 5/654.1
2015/0104604 A1 * 4/2015 Rock ..... B32B 5/026 428/86
2016/0066715 A1 * 3/2016 Hannula ..... A47G 9/0246 5/499
2018/0070748 A1 * 3/2018 Bell ..... A47C 31/105

* cited by examiner

BED SHEETS WITH PERFORMANCE FABRIC

TECHNICAL FIELD

The present disclosure generally relates to bedding, and more particularly to bed sheets configured to be fit to a mattress in a manner that prevents the bed sheet from slipping off a mattress.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable, in order to achieve restful sleep.

Typically, a fitted bed sheet is positioned over a mattress and a flat bed sheet is positioned on top of the fitted bed sheet. One or more sleepers position their body(ies) between the fitted bed sheet and the flat bed sheet. Conventional fitted sheets include a strip of elastic about all or a portion of a perimeter of an edge of the bed sheet. The elastic strip is configured to hug or be cinched about the mattress to secure the sheet to the mattress. However, this is often insufficient to maintain the bed sheet on the mattress when one or more sleepers move during the night. For example, when a sleeper tugs on one corner of the bedsheet, an opposite corner may pull away from the mattress. Furthermore, the elastic strip of such conventional bed sheets is prone to wear out relatively quickly due to washing and/or being repeatedly stretched. After the elastic material wears out, the bedsheet may come off the mattress even with minimal movement by one or more sleepers. Still further, the elastic strip may detach from the bedsheet itself due to washing, for example, thus rendering it ineffective in securing the bed sheet to the mattress. This disclosure describes an improvement over these prior art technologies.

SUMMARY

In one embodiment, in accordance with the principles of the present disclosure, fitted bed sheets are provided. The bed sheets each include top, side and end panels. Adjacent ends of the side and end panels are joined to form a seam at a corner of the sheet. The side and end panels each have a lower edge that is spaced apart from the top panel. At least one of the corners includes a power band having a first side that extends from a portion of the lower edge of one of the end panels to one of the seams. A second side of the power band extends from a portion of the lower edge of one of the side panels to the one of the seams. A third side of the power band extends from the portion of the lower edge of the one of the end panels to the portion of the lower edge of the one of the side panels.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
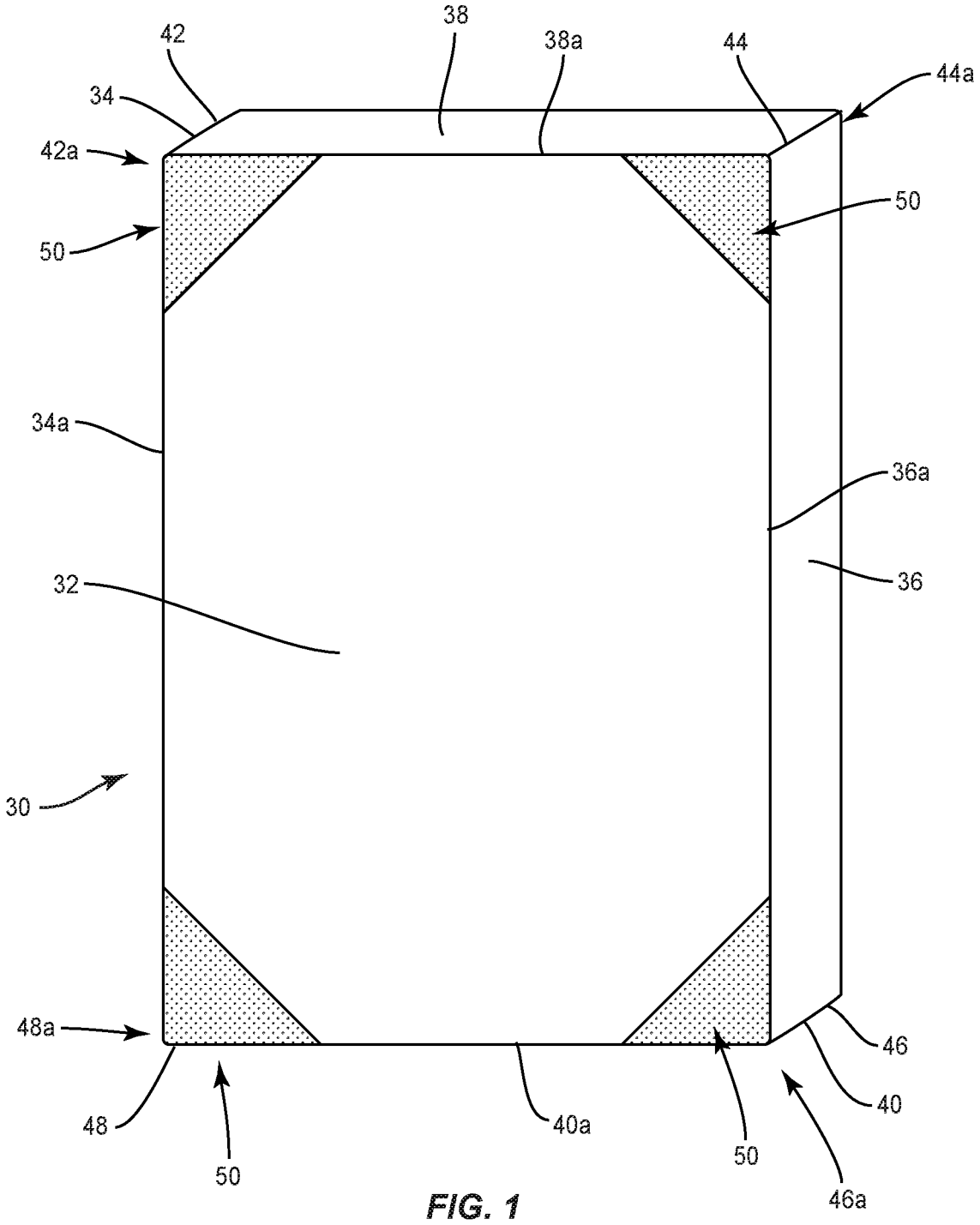
FIG. 1 is a bottom, perspective view of a bed sheet in accordance with the principles of the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other, and are not necessarily "superior" and "inferior".

The following discussion includes a description of bed sheets in accordance with the principles of the present disclosure. Alternate embodiments are also disclosed. Reference will now be made in detail to the exemplary embodiments of the present disclosure, which are illustrated in the accompanying figures. Turning to FIGS. 1-16, there are illustrated a sheet set that includes a fitted bed sheet 30.

In some embodiments, bed sheet 30 is configured to cover all or a portion of a top surface of the mattress. In some embodiments, bed sheet 30 is configured to be larger than the top surface of the mattress such that at least a portion of bed sheet 30 covers all or a portion of a side surface of the mattress. In some embodiments, bed sheet 30 has substantially the same size and shape as the top surface of the mattress. In some embodiments, the mattress is a standard size mattress, such as, for example, a twin mattress, a full mattress, a queen mattress, a king mattress, or a California king mattress. In some embodiments, the mattress is a crib mattress. In some embodiments, the mattress is a memory foam mattress, an orthopedic mattress (with or without springs), a foam mattress, a mattress that includes gel, a crib mattress, a couch mattress or lounge pad.

Bed sheet 30 includes a top panel 32 that is configured to engage a top surface of a mattress. Opposite side panels 34, 36 extend from panel 32 and opposite end panels 38, 40 that extend from panel 32. Panels 34, 36, 38, 40 are configured to engage side and end panels of a mattress when panel 32 engages the top surface of the mattress. In some embodiments, panels 34, 36, 38, 40 have a height that is equal to the side and end panels of the mattress. In some embodiments, panels 34, 36, 38, 40 have a height that less than the side and end panels of the mattress. In some embodiments, panels 34, 36, 38, 40 have a height that greater than the side and end panels of the mattress. Panels 38, 40 extend between panels 34, 36 to space panel 34 apart from panel 36. Likewise, panels 34, 36 extend between panels 38, 40 to space panel 38 apart from panel 40.

In some embodiments, panels 34, 36, 38, 40 are continuous with panel 32 such that there are no seams between panels 32, 34, between panels 32, 36, between panels 32, 38, or between panels 32, 40. In some embodiments, panels 34, 36, 38, 40 are joined to panel 32 such that there are seams between panels 32, 34, between panels 32, 36, between panels 32, 38, and between panels 32, 40. In some embodiments, panel 32 and panels 34, 36, 38, 40 each comprise the same material, such as, for example, one of the materials discussed herein. In some embodiments, panel 32 is made from a first material and at least one of panels 34, 36, 38, 40 is made from a second material that is different from the first material. In some embodiments, at least one of panels 34, 36, 38, 40 is free of any elastic material. In some embodiments, at least one of panels 34, 36, 38, 40 is made from or joined with an elastic material.

In some embodiments, panels 34, 36, 38, 40 may be disposed at alternate orientations, relative to panel 32, such as, for example, transverse, perpendicular and/or other angular orientations such as acute or obtuse, co-axial and/or may be offset or staggered. In some embodiments, panel 34 and panel 36 may be disposed at alternate orientations, relative to one another, such as, for example, parallel or transverse and/or other angular orientations such as acute or obtuse and/or may be offset or staggered. In some embodiments, panels 34, 36 may be disposed at alternate orientations, relative to panels 38, 40, such as, for example, transverse, perpendicular and/or other angular orientations such as acute or obtuse, co-axial and/or may be offset or staggered. In some embodiments, panel 38 and panel 40 may be disposed at alternate orientations, relative to one another, such as, for example, parallel or transverse and/or other angular orientations such as acute or obtuse and/or may be offset or staggered.

Panel 34 has a lower edge 34*a*; panel 36 has a lower edge 36*a*; panel 38 has a lower edge 38*a*; and panel 40 has a lower edge 40*a*. Edges 34*a*, 36*a*, 38*a*, 40*a* are spaced apart from panel 32 by panels 34, 36, 38, 40. Panel 34 and panel 38 are joined by a seam 42 at a corner 42*a* of bed sheet 30; panel 36 and panel 38 are joined by a seam 44 at a corner 44*a* of bed sheet 30; panel 36 and panel 40 are joined by a seam 46 at a corner 46*a* of bed sheet 30; and panel 34 and panel 40 are joined by a seam 48 at a corner 48*a* of bed sheet 30. Seam 42 extends from panel 32 to edges 34*a*, 38*a*; seam 44 extends from panel 32 to edges 36*a*, 38*a*; seam 46 extends from panel 32 to edges 36*a*, 40*a*; and seam 48 extends from panel 32 to edges 34*a*, 40*a*. In some embodiments, seams 42, 44, 46, 48 extend parallel to one another. In some embodiments, at least one of seams 42, 44, 46, 48 may be disposed at alternate orientations, relative to panel 32, such as, for example, transverse, perpendicular and/or other angular orientations such as acute or obtuse and/or may be offset or staggered.

At least one of corners 42*a*, 44*a*, 46*a*, 48*a* includes a power band 50 configured to secure bed sheet 30 to the mattress. That is, when panel 32 of bed sheet engages the top surface of the mattress and panels 34, 36, 38, 40 engage side and end panels of the mattress, power band 50 engages a bottom surface of the mattress that is opposite the top surface of the mattress. This configuration allows bed sheet 30 to be secured to the mattress in a manner that prevents bed sheet 30 from being inadvertently removed from the mattress. In some embodiments, power bands 50 each extend continuously along two of panels 34, 36, 38, 40 to one of seams 42, 44, 46, 48 and extend from one of panels 34, 36, 38, 40 to another one of panels 34, 36, 38, 40.

In some embodiments, bed sheet 30 comprises a power band 50 in corner 42*a*. The power band 50 in corner 42*a* has a first side that extends continuously along edge 34*a* from a portion of panel 34 that is spaced apart from seam 42 to seam 42, a second side that extends continuously along edge 38*a* from a portion of panel 38 that is spaced apart from seam 42 to seam 42, and a third side that extends from the portion of panel 34 that is spaced apart from seam 42 to the portion of panel 38 that is spaced apart from seam 42. The first side extends transverse or perpendicular to the second side and the third side extends transverse to the first and second sides. In some embodiments, the first, second and third sides are equal in length. In some embodiments, two of the first, second and third sides have the same length and the other one of the first, second and third sides has a length that is less than or greater than the length of the two of the first, second and third sides. In some embodiments, the first, second and third sides each have a different length.

In some embodiments, bed sheet 30 comprises a power band 50 in corner 44*a*. The power band 50 in corner 44*a* has a first side that extends continuously along edge 36*a* from a portion of panel 36 that is spaced apart from seam 44 to seam 44, a second side that extends continuously along edge 38*a* from a portion of panel 38 that is spaced apart from seam 44 to seam 44, and a third side that extends from the portion of panel 36 that is spaced apart from seam 44 to the portion of panel 38 that is spaced apart from seam 44. The first side extends transverse or perpendicular to the second side and the third side extends transverse to the first and second sides. In some embodiments, the first, second and third sides are equal in length. In some embodiments, two of the first, second and third sides have the same length and the other one of the first, second and third sides has a length that is less than or greater than the length of the two of the first, second and third sides. In some embodiments, the first, second and third sides each have a different length.

In some embodiments, bed sheet 30 comprises a power band 50 in corner 46*a*. The power band 50 in corner 46*a* has a first side that extends continuously along edge 36*a* from a portion of panel 36 that is spaced apart from seam 46 to seam 46, a second side that extends continuously along edge 40*a* from a portion of panel 40 that is spaced apart from seam 46 to seam 46, and a third side that extends from the portion of panel 36 that is spaced apart from seam 46 to the portion of panel 40 that is spaced apart from seam 46. The first side extends transverse or perpendicular to the second side and the third side extends transverse to the first and second sides. In some embodiments, the first, second and third sides are equal in length. In some embodiments, two of the first, second and third sides have the same length and the other one of the first, second and third sides has a length that is less than or greater than the length of the two of the first, second and third sides. In some embodiments, the first, second and third sides each have a different length.

In some embodiments, bed sheet 30 comprises a power band 50 in corner 48*a*. The power band 50 in corner 48*a* has a first side that extends continuously along edge 34*a* from a portion of panel 34 that is spaced apart from seam 48 to seam 48, a second side that extends continuously along edge 40*a* from a portion of panel 40 that is spaced apart from seam 48 to seam 48, and a third side that extends from the portion of panel 34 that is spaced apart from seam 48 to the portion of panel 40 that is spaced apart from seam 48. The first side extends transverse or perpendicular to the second side and the third side extends transverse to the first and second sides. In some embodiments, the first, second and third sides are equal in length. In some embodiments, two of the first, second and third sides have the same length and the other one of the first, second and third sides has a length that is less than or greater than the length of the two of the first, second and third sides. In some embodiments, the first, second and third sides each have a different length.

In operation and use, bed sheet 30, such as, for example, bed sheet 30 shown in FIG. 1, may be secured to the mattress by positioning two of powerbands 50 at two of corners 42*a*, 44*a*, 46*a*, 48*a* about two corners of the mattress and then sequential positioning the two other powerbands 50 at two other corners 42*a*, 44*a*, 46*a*, 48*a* about the two other corners of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46 is then stretched over the bottom left corner of the mattress such that the power band 50 in corner 46*a* engages the bottom surface of the mattress to secure bed sheet 30 to the mattress.

Figure 2:
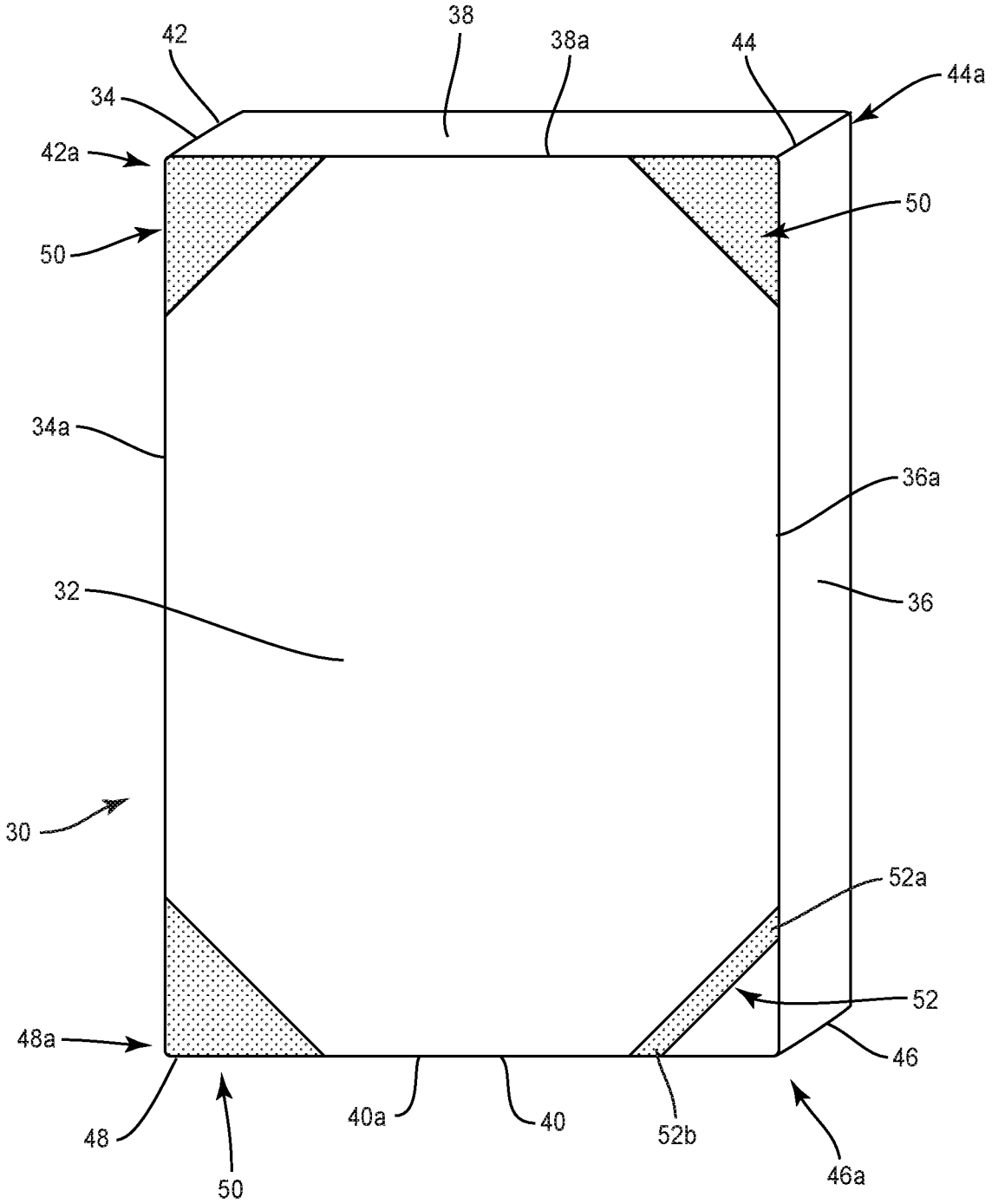
FIG. 2 is a bottom, perspective view of a bed sheet in accordance with the principles of the present disclosure.

In some embodiments, at least one of corners 42*a*, 44*a*, 46*a*, 48*a* includes a power band 50 and at least one of corners 42*a*, 44*a*, 46*a*, 48*a* includes a strip 52, as shown in FIG. 2. In some embodiments, three of corners 42*a*, 44*a*, 46*a*, 48*a* include a power band 50 and the other one of corners 42*a*, 44*a*, 46*a*, 48*a* includes a strip 52. Strip 52 may be made from the same material as power bands 50 or from a different material. In some embodiments, power bands 50 and/or strips 52 are made from an elastic material. In some embodiments, power bands 50 and/or strips 52 are made from an inelastic material. As shown in FIG. 2, unlike power bands 50, strips 52 do not occupy an entire portion of any one of corners 42*a*, 44*a*, 46*a*, 48*a*. That is, strips 52 are spaced apart from seams 42, 44, 46, 48. In particular, strips 52 each extend from a portion of one of edges 34*a*, 36*a*, 38*a*, 40*a* that is spaced apart from seams 42, 44, 46, 48 to a portion of another one of edges 34*a*, 36*a*, 38*a*, 40*a* that is spaced apart from seams 42, 44, 46, 48. For example, in one embodiment, shown in FIG. 2, strip 52 is positioned at corner 46*a*. An end 52*a* of strip 52 engages a portion of edge 36*a* that is spaced apart from seam 46 and an opposite end 52*b* of strip 52 engages a portion of edge 40*a* that is spaced apart from seam 46. Strip 52 extends continuously from end 52*a* to end 52*b*.

In operation and use, bed sheet 30, such as, for example, bed sheet 30 shown in FIG. 2, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strip 52 is then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Strip 52 is then stretched over the bottom left corner of the mattress such that the strip 52 engages the bottom surface of the mattress to secure bed sheet 30 to the mattress.

Figure 3:
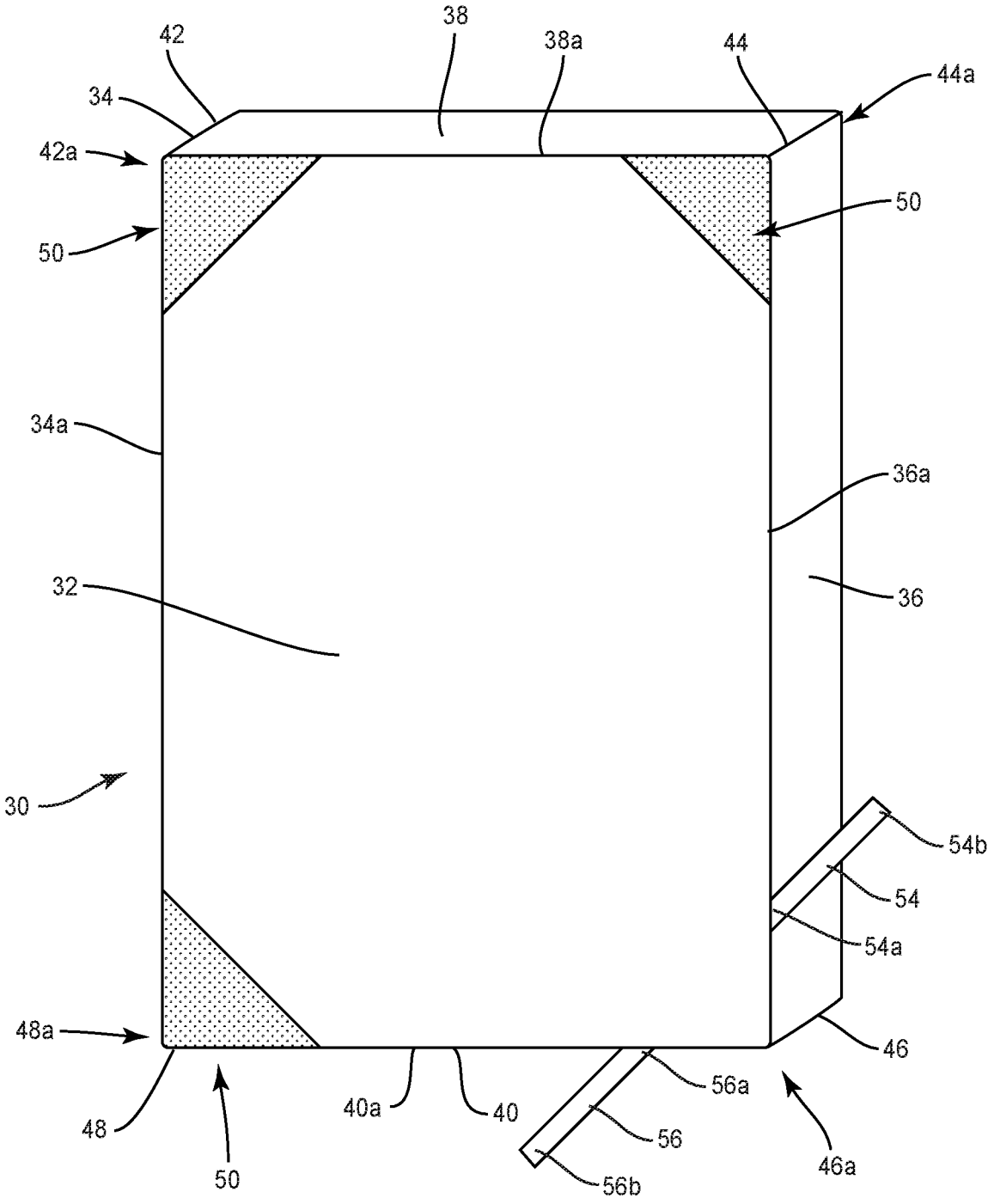
FIG. 3 is a bottom, perspective view of a bed sheet in accordance with the principles of the present disclosure.

In some embodiments, at least one of corners 42*a*, 44*a*, 46*a*, 48*a* includes a power band 50 and at least one of corners 42*a*, 44*a*, 46*a*, 48*a* includes a strip 54 and a strip 56, as shown in FIG. 3. In some embodiments, three of corners 42*a*, 44*a*, 46*a*, 48*a* include a power band 50 and the other one of corners 42*a*, 44*a*, 46*a*, 48*a* includes strips 54, 56. Strips 54, 56 are spaced apart from seams 42, 44, 46, 48. In particular, strips 54, 56 each extend from a portion of one of edges 34*a*, 36*a*, 38*a*, 40*a* that is spaced apart from seams 42, 44, 46, 48. For example, in one embodiment, shown in FIG. 3, strips 54, 56 are positioned at corner 46*a*. An end 54*a* of strip 54 engages a portion of edge 36*a* that is spaced apart from seam 46 and an end 56*a* of strip 56 engages a portion of edge 40*a* that is spaced apart from seam 46. Strips 54, 56 are configured to be folded about a corner of the mattress such that ends 54*b*, 56*b* of strips 54, 56 engage one another to fix strip 54 relative to strip 56. In some embodiments, strips 54, 56 comprise hook and loop fasteners, such as, for example, Velcro. For example, in one embodiment, one of strips 54, 56 includes hook fasteners and the other one of strips 54, 56 comprises loop fasteners that engage the hook fasteners to prevent strip 54 from disengaging strip 56 without an application of force in a particular direction. Strips 54, 56 are thus movable from a first configuration in which strip 56 is spaced apart from strip 54, as shown in FIG. 3, to a second configuration, shown in FIG. 4, in which end 54*b* engages end 56*b* to fix strip 54 relative to strip 56. That is, when end 54*b* engages end 56*b*, the hook and loop fasteners discussed herein engage to fix strip 54 relative to strip 56.

Figure 4:
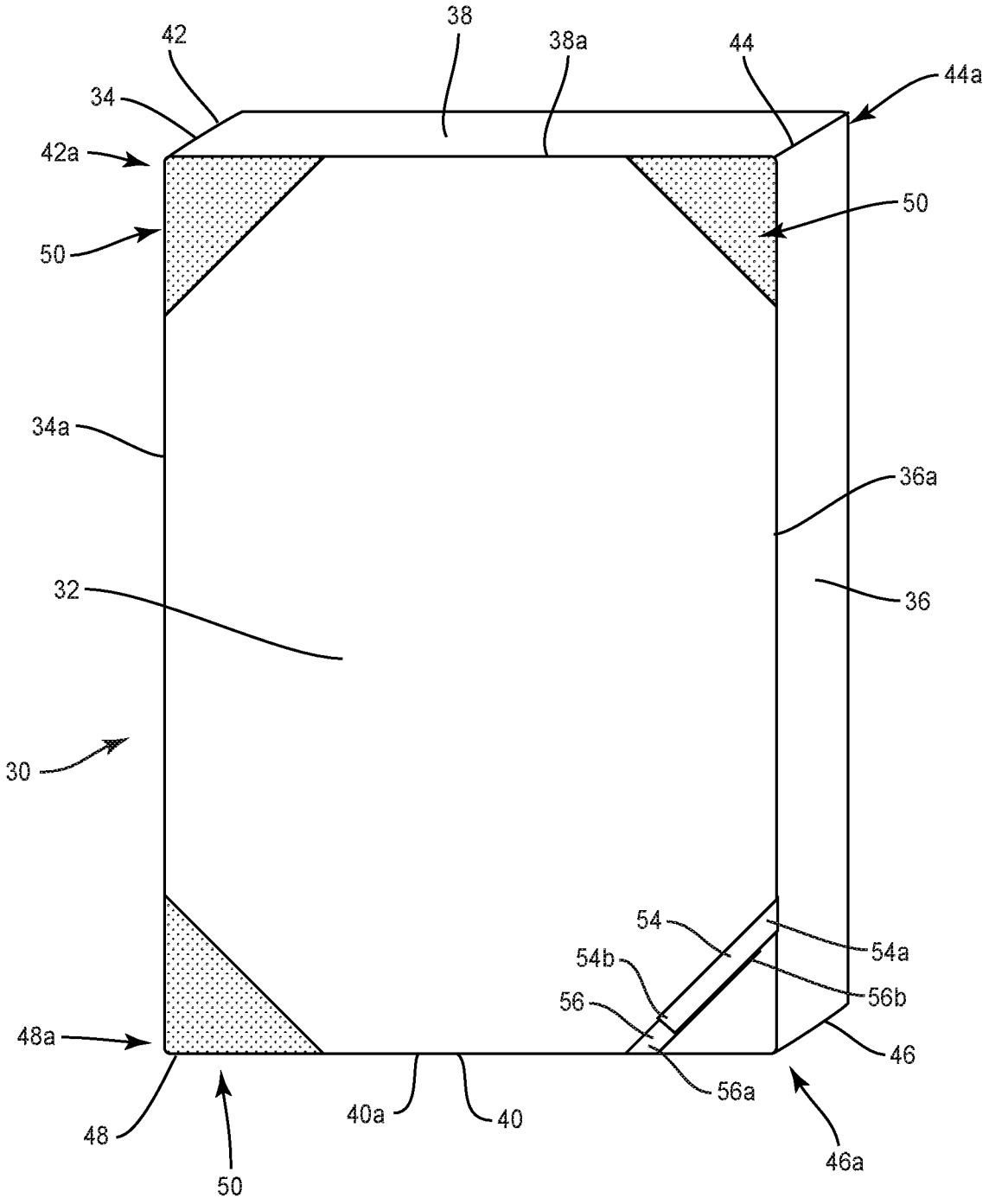
FIG. 4 is a bottom, perspective view of the bed sheet shown in FIG. 3.

In operation and use, bed sheet 30, such as, for example, bed sheet 30 shown in FIGS. 3 and 4, may be secured to the mattress by positioning two of power bands 50 at two of corners 42*a*, 44*a*, 46*a*, 48*a* about two corners of the mattress.

A third one of power bands 50 is then positioned over one of the other corners of the mattress as discussed herein. Strips 54, 56 are then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46*a* is positioned about the bottom left corner of the mattress. Strips 54, 56 are then moved from the first configuration discussed above to the second configuration discussed above such that strips 54, 56 are positioned under the bottom left corner of the mattress with strips 54, 56 fixed relative to one another to secure bed sheet 30 to the mattress. Bed sheet 30 may be removed from the mattress by applying a force to strips 54, 56 in a particular direction sufficient to remove the loop fasteners from the hook fasteners. Corners 42*a*, 44*a*, 46*a*, 48*a* may then be removed from the mattress one corner at a time.

Figure 5:
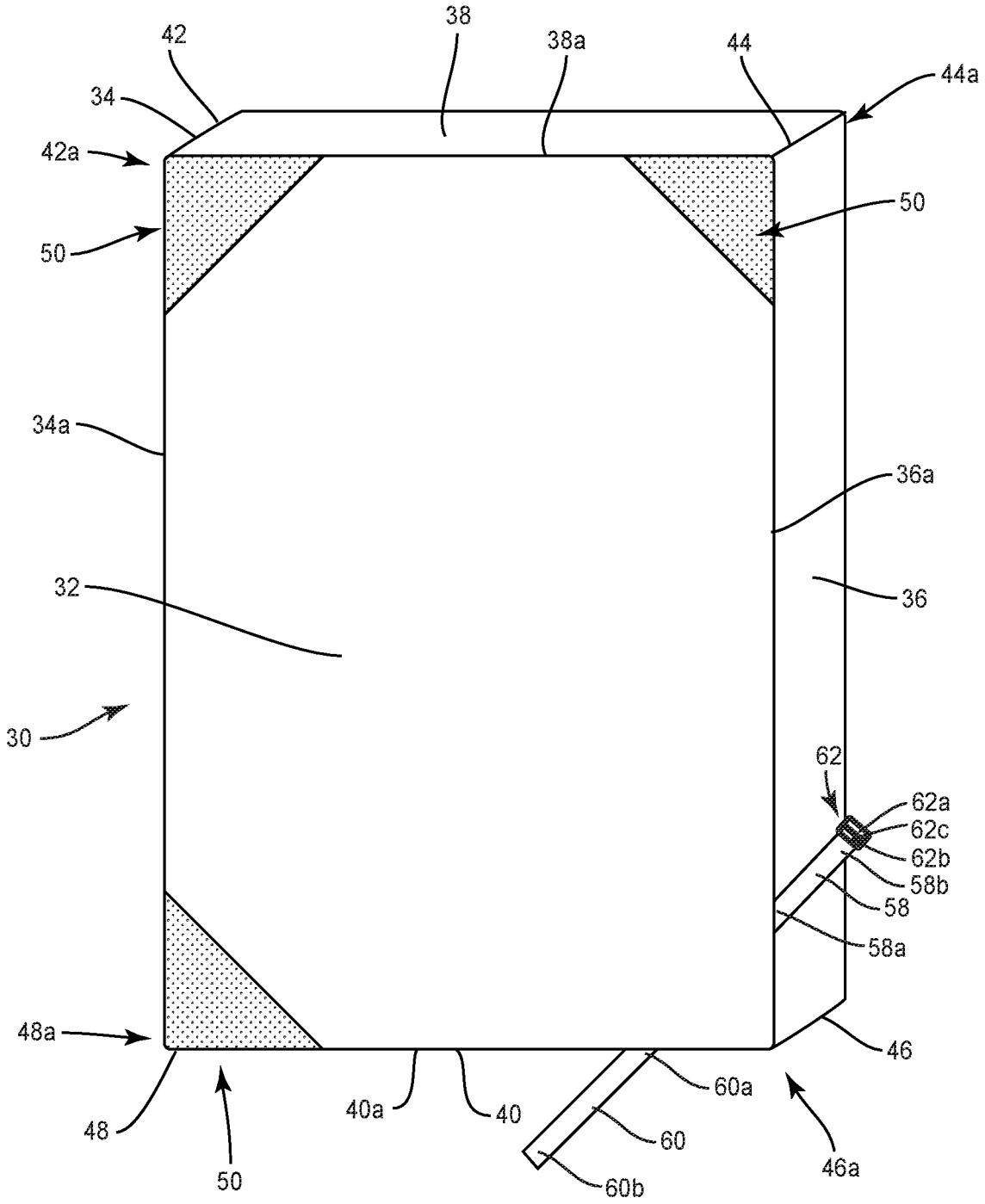
FIG. 5 is a bottom, perspective view of a bed sheet in accordance with the principles of the present disclosure.

In some embodiments, at least one of corners 42*a*, 44*a*, 46*a*, 48*a* includes a power band 50 and at least one of corners 42*a*, 44*a*, 46*a*, 48*a* includes a strip 58 and a strip 60. One of strips 58, 60 includes a buckle 62, as shown in FIG. 5. In some embodiments, three of corners 42*a*, 44*a*, 46*a*, 48*a* include a power band 50 and the other one of corners 42*a*, 44*a*, 46*a*, 48*a* includes strips 58, 60. Strips 58, 60 are spaced apart from seams 42, 44, 46, 48. In particular, strips 58, 60 each extend from a portion of one of edges 34*a*, 36*a*, 38*a*, 40*a* that is spaced apart from seams 42, 44, 46, 48. For example, in one embodiment, shown in FIG. 5, strips 56, 60 are positioned at corner 46*a*. An end 58*a* of strip 58 engages a portion of edge 36*a* that is spaced apart from seam 46 and an end 60*a* of strip 60 engages a portion of edge 40*a* that is spaced apart from seam 46. Strips 58, 60 are configured to be folded about a corner of the mattress such that ends 58*b*, 60*b* of strips 55, 60 engage one another to fix strip 58 relative to strip 60. Buckle 62 includes an opening 62*a* and an opening 62*b* that is spaced apart from opening 62*a* by a bar 62*c*. End 60*b* is configured to be moved through buckle 62 to fix strip 60 relative to strip 58. In particular, end 60*b* may be moved through opening 62*a*, under bar 62*c* and out of opening 62*b* such that strip 60 is prevented from moving relative to strip 58. Strips 58, 60 are thus movable from a first configuration in which strip 60 is spaced apart from buckle 62, as shown in FIG. 5, to a second configuration, shown in FIG. 6, in which end 60*b* is threaded through buckle 62 in the manner discussed herein to fix strip 58 relative to strip 60.

Figure 6:
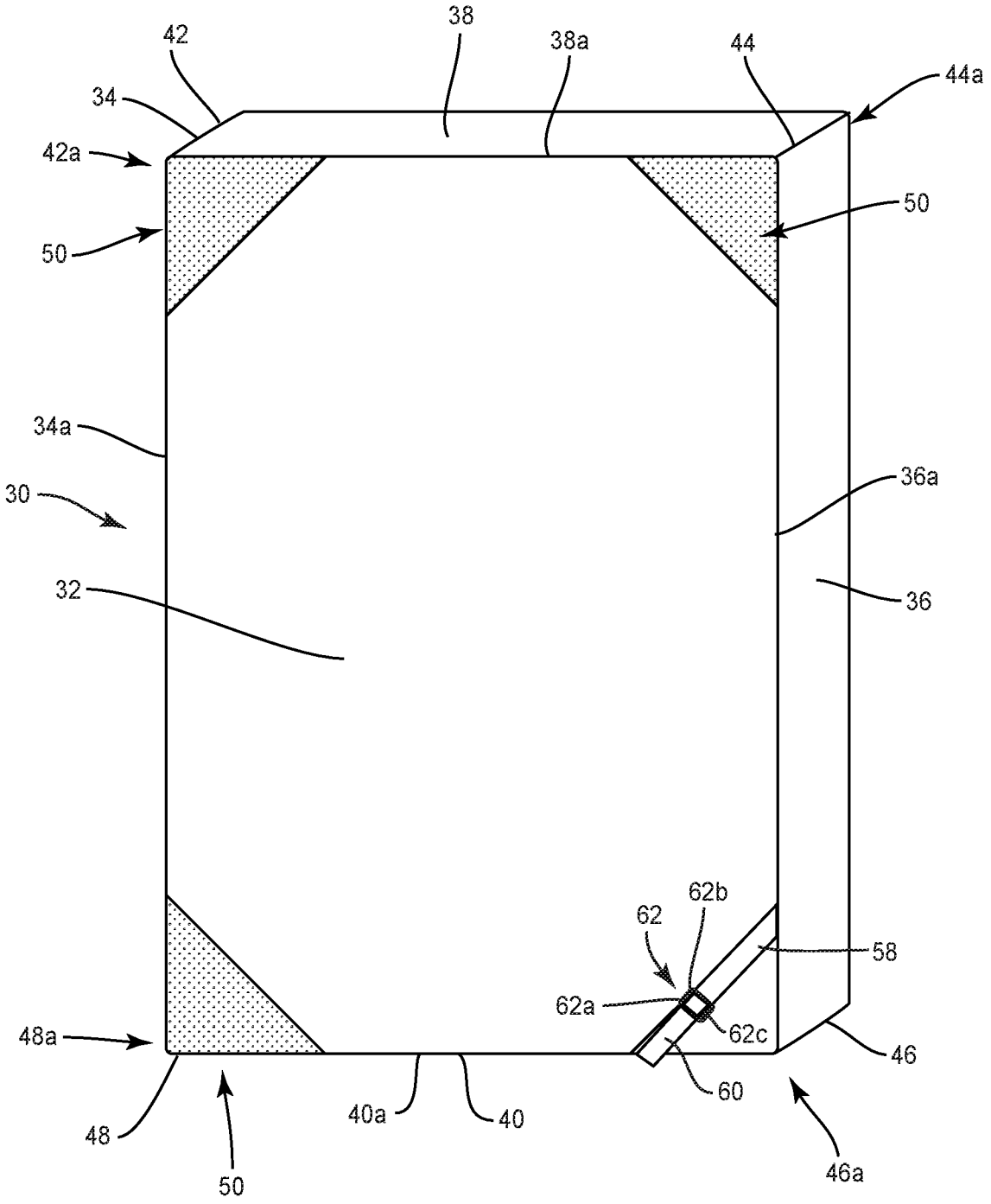
FIG. 6 is a bottom, perspective view of a bed sheet in accordance with the principles of the present disclosure.

In operation and use, bed sheet 30, such as, for example, bed sheet 30 shown in FIGS. 5 and 6, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strips 58, 60 are then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46*a* is positioned about the bottom left corner of the mattress. Strips 58, 60 are then moved from the first configuration discussed above to the second configuration discussed above such that strips 58, 60 are positioned under the bottom left corner of the mattress with strips 58, 60 fixed relative to one another to secure bed sheet 30 to the mattress. Bed sheet 30 may be removed from the mattress by unthreading strip 60 from buckle 62. Corners 42*a*, 44*a*, 46*a*, 48*a* may then be removed from the mattress one corner at a time.

Figure 7:
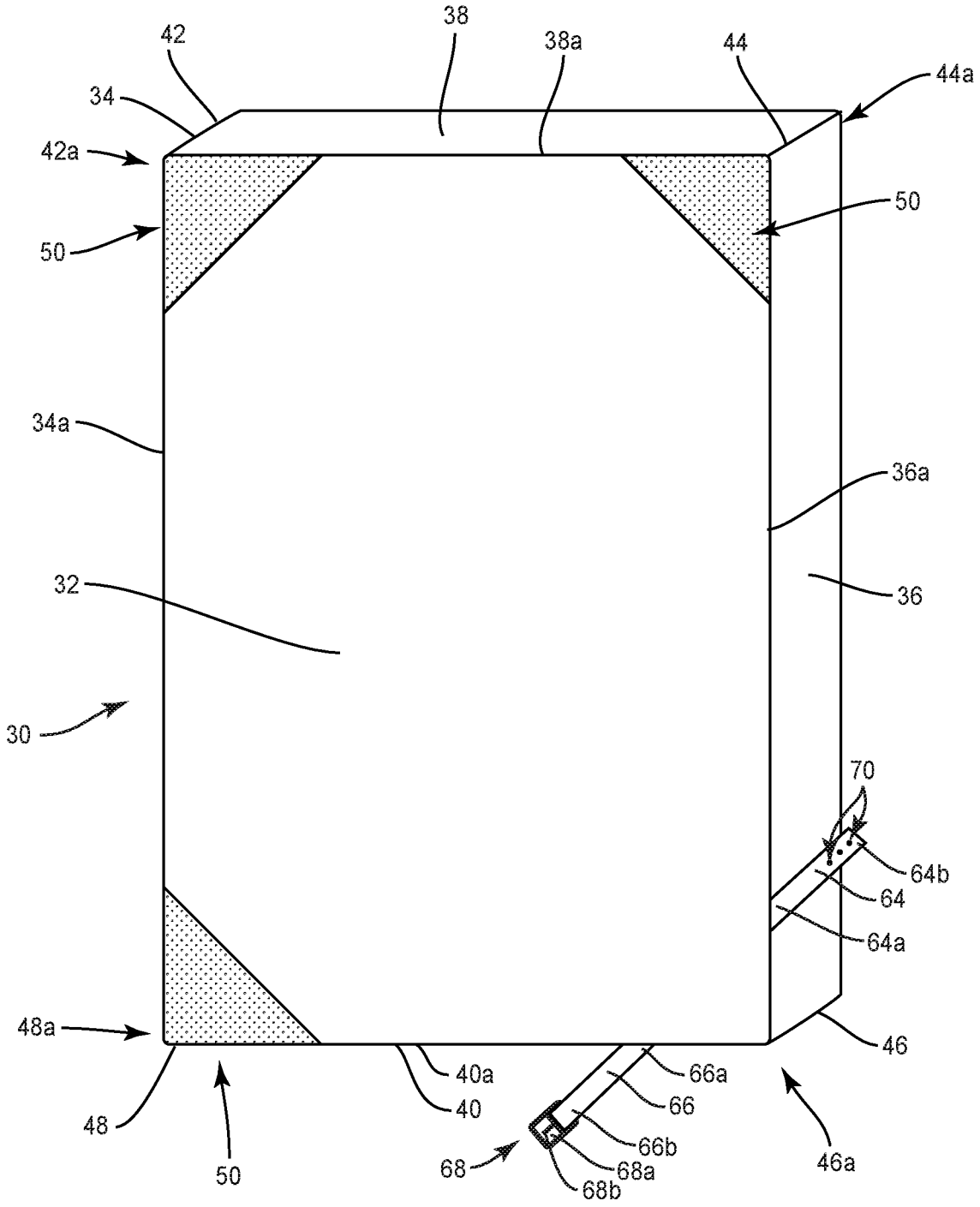
FIG. 7 is a perspective view of a bed sheet in accordance with the principles of the present disclosure.

In some embodiments, at least one of corners 42*a*, 44*a*, 46*a*, 48*a* includes a power band 50 and at least one of corners 42*a*, 44*a*, 46*a*, 48*a* includes a strip 64 and a strip 66. One of strips 64, 66 includes a buckle 68 and the other one of strips 64, 66 includes holes 70, as shown in FIG. 7. In some embodiments, three of corners 42*a*, 44*a*, 46*a*, 48*a* include a power band 50 and the other one of corners 42*a*, 44*a*, 46*a*, 48*a* includes strips 64, 66. Strips 64, 66 are spaced apart from seams 42, 44, 46, 48. In particular, strips 64, 66 each extend from a portion of one of edges 34*a*, 36*a*, 38*a*, 40*a* that is spaced apart from seams 42, 44, 46, 48. For example, in one embodiment, shown in FIG. 7, strips 64, 66 are positioned at corner 46*a*. An end 64*a* of strip 64 engages a portion of edge 36*a* that is spaced apart from seam 46 and an end 66*a* of strip 66 engages a portion of edge 40*a* that is spaced apart from seam 46. Strips 64, 66 are configured to be folded about a corner of the mattress such that ends 64*b*, 66*b* of strips 64, 66 engage one another to fix strip 64 relative to strip 66. Buckle 68 includes an opening 68*a* and a pin 68*b* that is movable relative to end 66*b*. End 64*b* is configured to be moved through buckle 68 to fix strip 64 relative to strip 66. In particular, end 64*b* may be moved through opening 68*a* such that pin 68*b* is positioned in one of holes 70 to prevent strip 64 from moving relative to strip 66. Strips 64, 66 are thus movable from a first configuration in which strip 64 is spaced apart from buckle 68, as shown in FIG. 7, to a second configuration, shown in FIG. 8, in which end 64*b* is positioned within opening 68*a* and pin 68*b* extends through one of holes 70 to fix strip 64 relative to strip 66.

Figure 8:
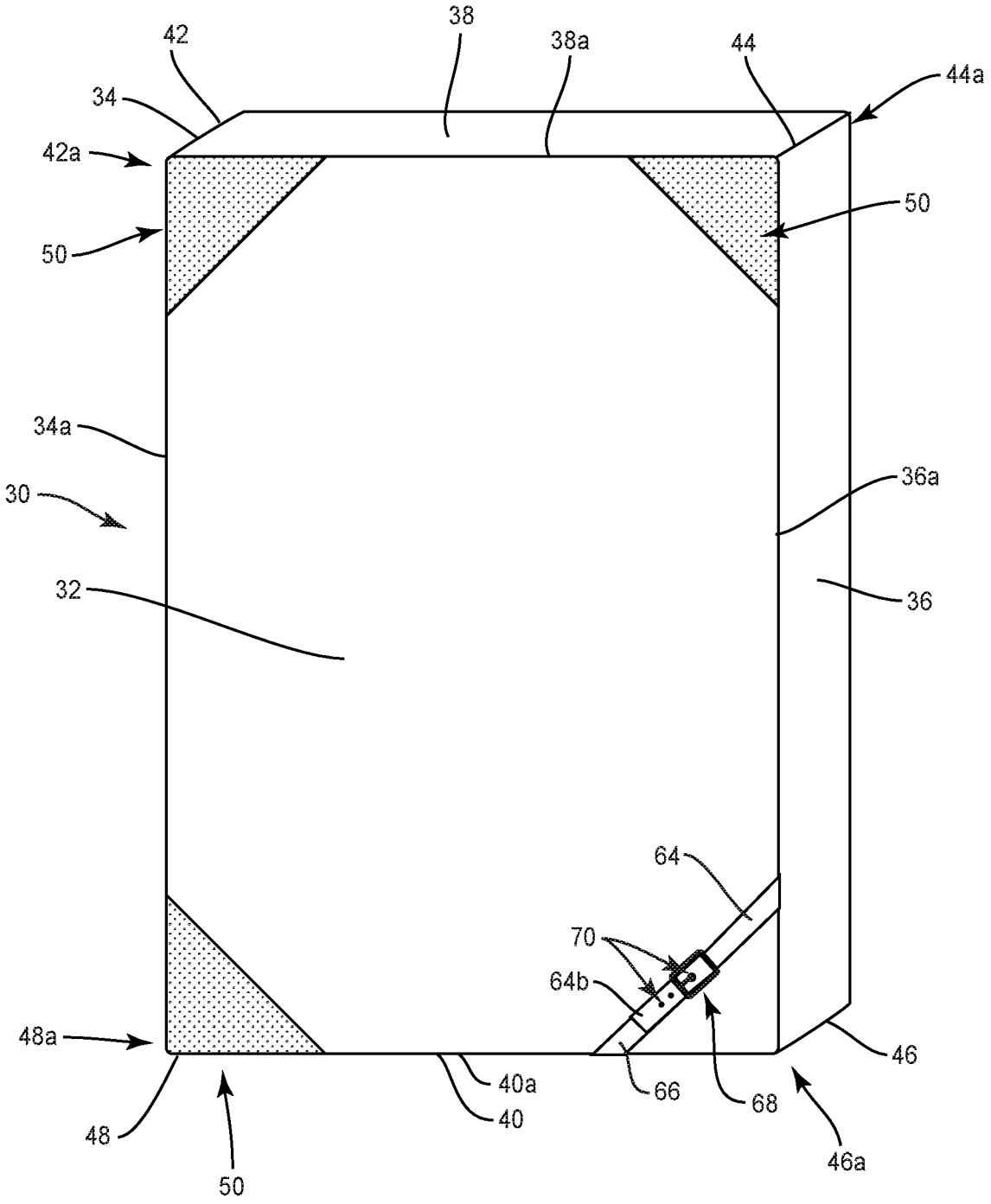
FIG. 8 is a bottom, perspective view of the bed sheet shown in FIG. 7.

In operation and use, bed sheet 30, such as, for example, bed sheet 30 shown in FIGS. 7 and 8, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strips 64, 68 are then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46*a* is positioned about the bottom left corner of the mattress. Strips 64, 66 are then moved from the first configuration discussed above to the second configuration discussed above such that strips 64, 66 are positioned under the bottom left corner of the mattress with strips 64, 66 fixed relative to one another to secure bed sheet 30 to the mattress. It is envisioned that pin 68*b* may be selectively positioned in one of holes 70 to provide bed sheet 30 with a tighter or looser fit about the bottom left corner of the mattress, as desired. Bed sheet 30 may be removed from the mattress by removing pin 68*b* from hole 70. Corners 42*a*, 44*a*, 46*a*, 48*a* may then be removed from the mattress one corner at a time.

Figure 9:
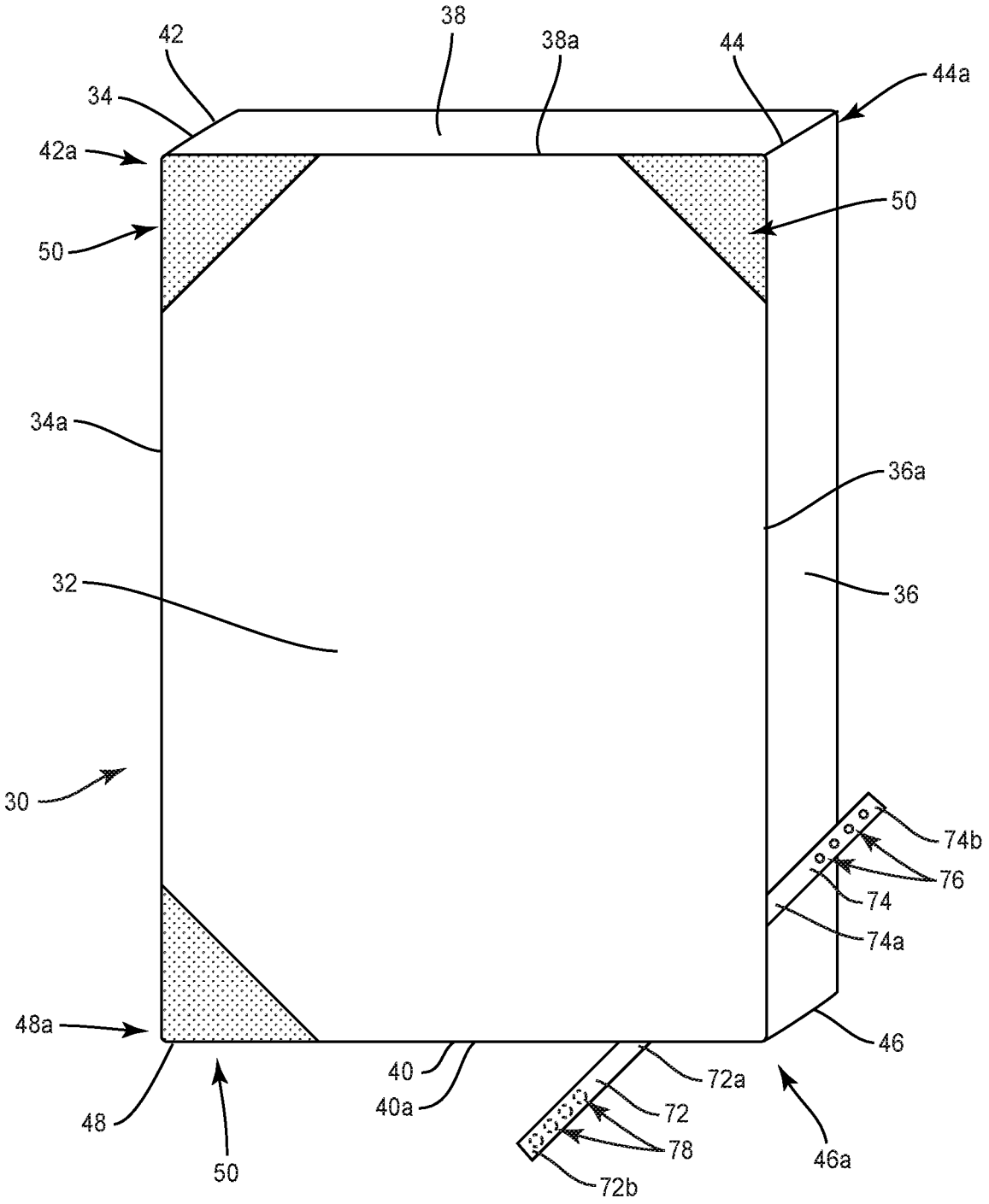
FIG. 9 is a bottom, perspective view of a bed sheet in accordance with the principles of the present disclosure.

In some embodiments, at least one of corners 42*a*, 44*a*, 46*a*, 48*a* includes a power band 50 and at least one of corners 42*a*, 44*a*, 46*a*, 48*a* includes a strip 72 and a strip 74. Strips 72, 74 may be attached or fixed to one another using snaps. As such, one of strips 72, 74 includes a series of male components, such as, for example, studs 76 and the other one of strips 72, 74 includes a series of female components, such as, for example, sockets 78, as shown in FIG. 9. Studs 76 are each configured to snap into one of sockets 78 to fix strips 72, 74 relative to one another. In some embodiments, at least one of studs 76 and/or sockets 78 include a cap. In some embodiments, three of corners 42*a*, 44*a*, 46*a*, 48*a* include a power band 50 and the other one of corners 42*a*, 44*a*, 46*a*, 48*a* includes strips 72, 74. Strips 72, 74 are spaced apart from seams 42, 44, 46, 48. In particular, strips 72, 74 each extend from a portion of one of edges 34*a*, 36*a*, 38*a*, 40*a* that is spaced apart from seams 42, 44, 46, 48. For example, in one embodiment, shown in FIG. 9, strips 72, 74 are positioned at corner 46*a*. An end 72*a* of strip 72 engages a portion of edge 40*a* that is spaced apart from seam 46 and an end 74*a* of strip 74 engages a portion of edge 36*a* that is spaced apart from seam 46. Strips 72, 74 are configured to be folded about a corner of the mattress such that ends 72*b*, 74*b* of strips 72, 74 engage one another to fix strip 72 relative to strip 74. Strips 72, 74 are movable from a first configuration in which strip 72 is spaced apart from strip 74, as shown in FIG. 9, to a second configuration, shown in FIG. 10, in which at least one of studs 76 is positioned within at least one of sockets 78 to fix strip 72 relative to strip 74. In some embodiments, only one of studs 76 is positioned within one of sockets 76 when strips 72, 74 are in the second configuration. In some embodiments, a plurality of studs 76 are positioned within a plurality of sockets 76 when strips 72, 74 are in the second configuration.

Figure 10:
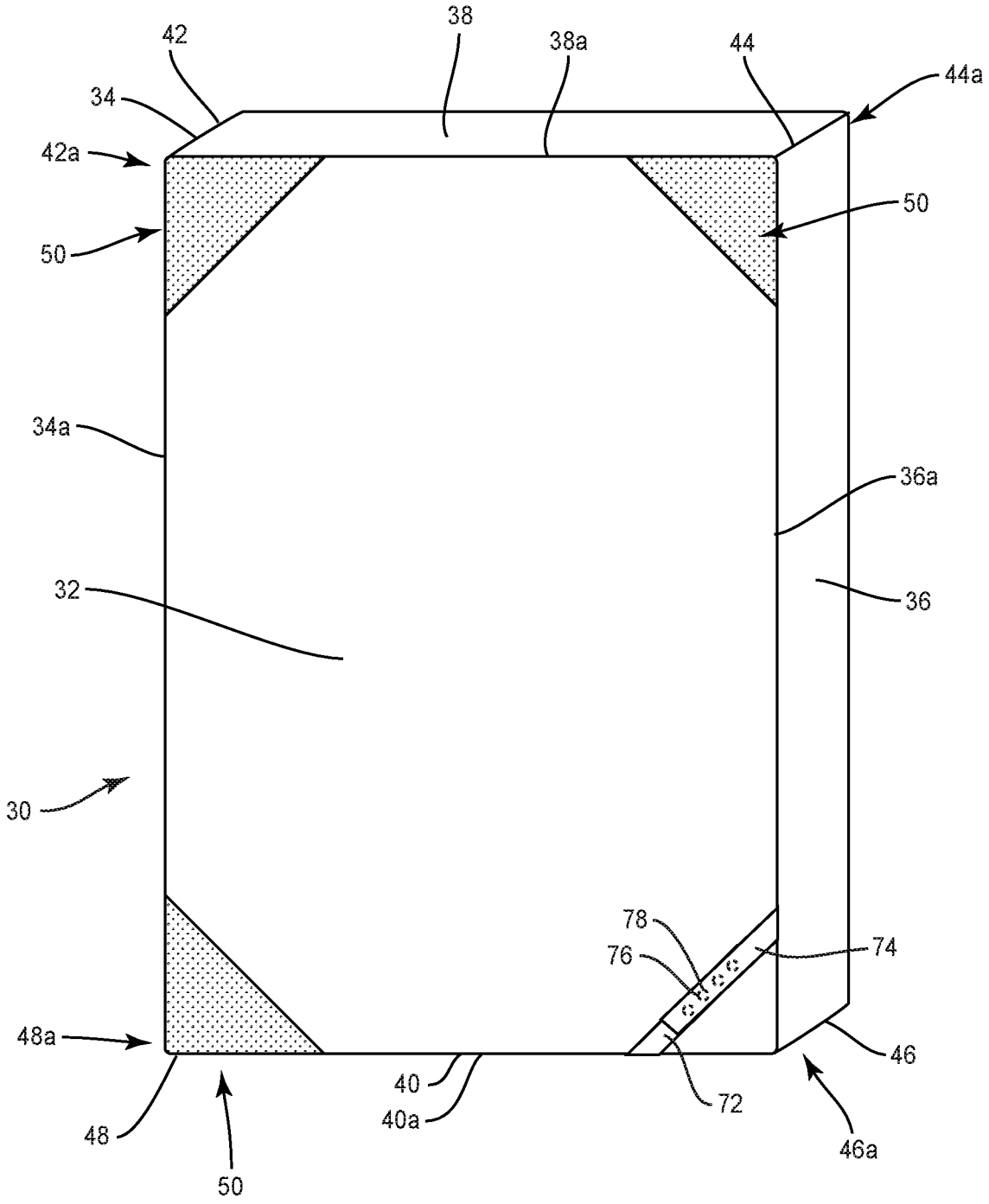
FIG. 10 is a bottom, perspective view of the bed sheet shown in FIG. 9.

In operation and use, bed sheet 30, such as, for example, bed sheet 30 shown in FIGS. 9 and 10, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strips 72, 74 are then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46*a* is positioned about the bottom left corner of the mattress. Strips 72, 74 are then moved from the first configuration discussed above to the second configuration discussed above such that strips 72, 74 are positioned under the bottom left corner of the mattress with strips 72, 74 fixed relative to one another to secure bed sheet 30 to the mattress. It is envisioned that stud(s) 76 may be selectively positioned in socket(s) 78 to provide a tighter or looser fit about the bottom left corner of the mattress, as desired. Bed sheet 30 may be removed from the mattress by removing stud(s) 76 from socket(s) 78. Corners 42*a*, 44*a*, 46*a*, 48*a* may then be removed from the mattress one corner at a time.

Figure 11:
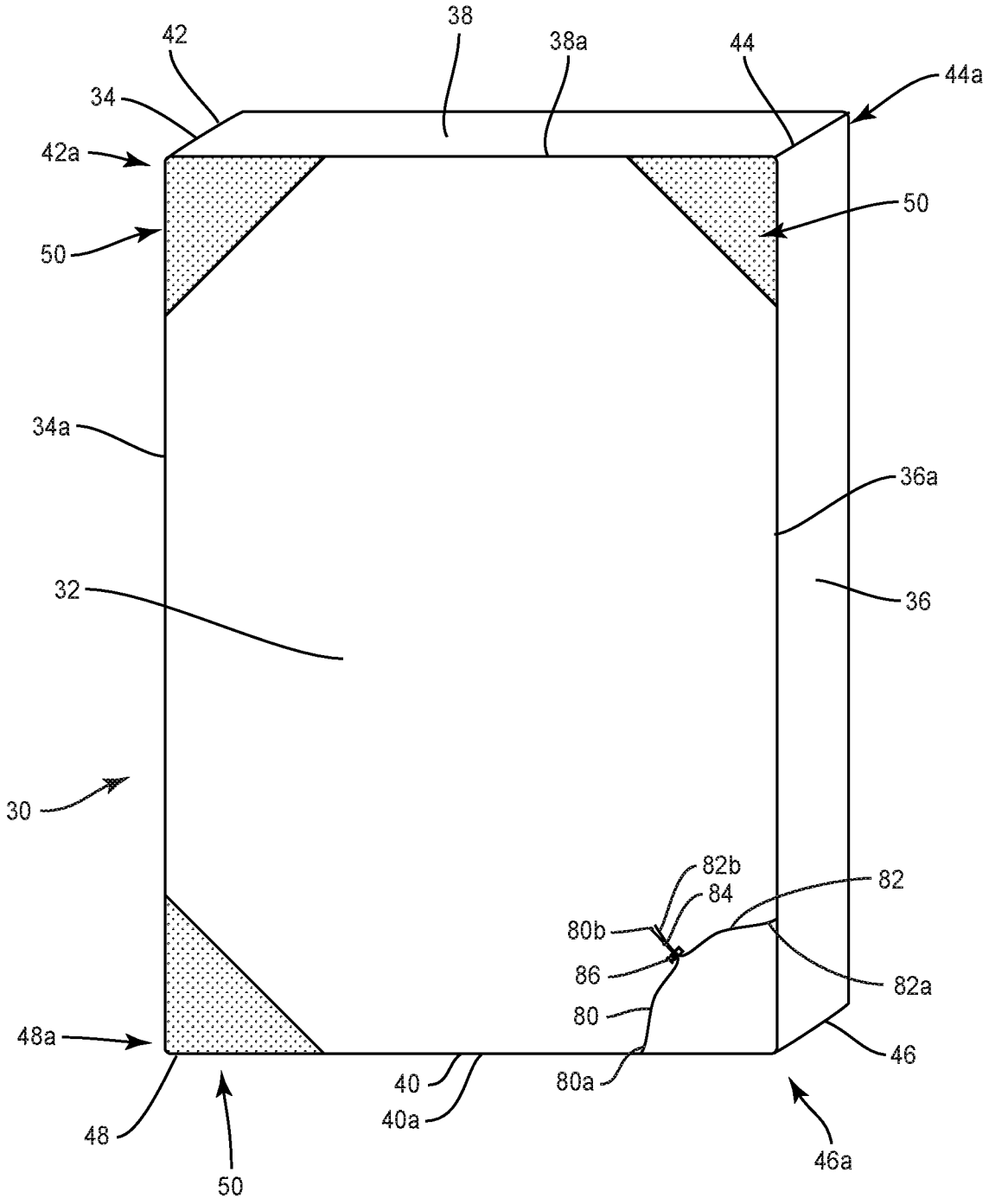
FIG. 11 is a bottom, perspective view of a bed sheet in accordance with the principles of the present disclosure.
Figure 11A:
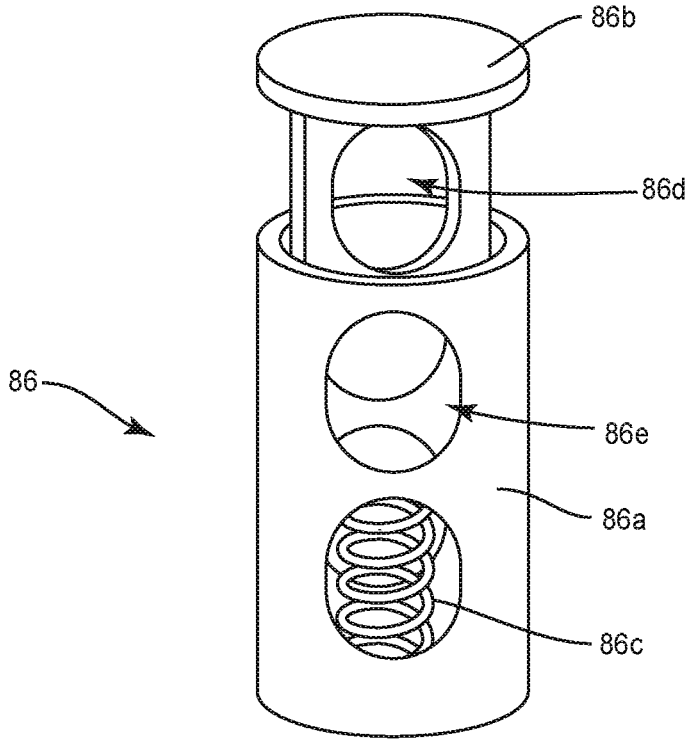
FIG. 11A is a side, perspective view of a component of the bed sheet shown in FIG. 11.
Figure 12:
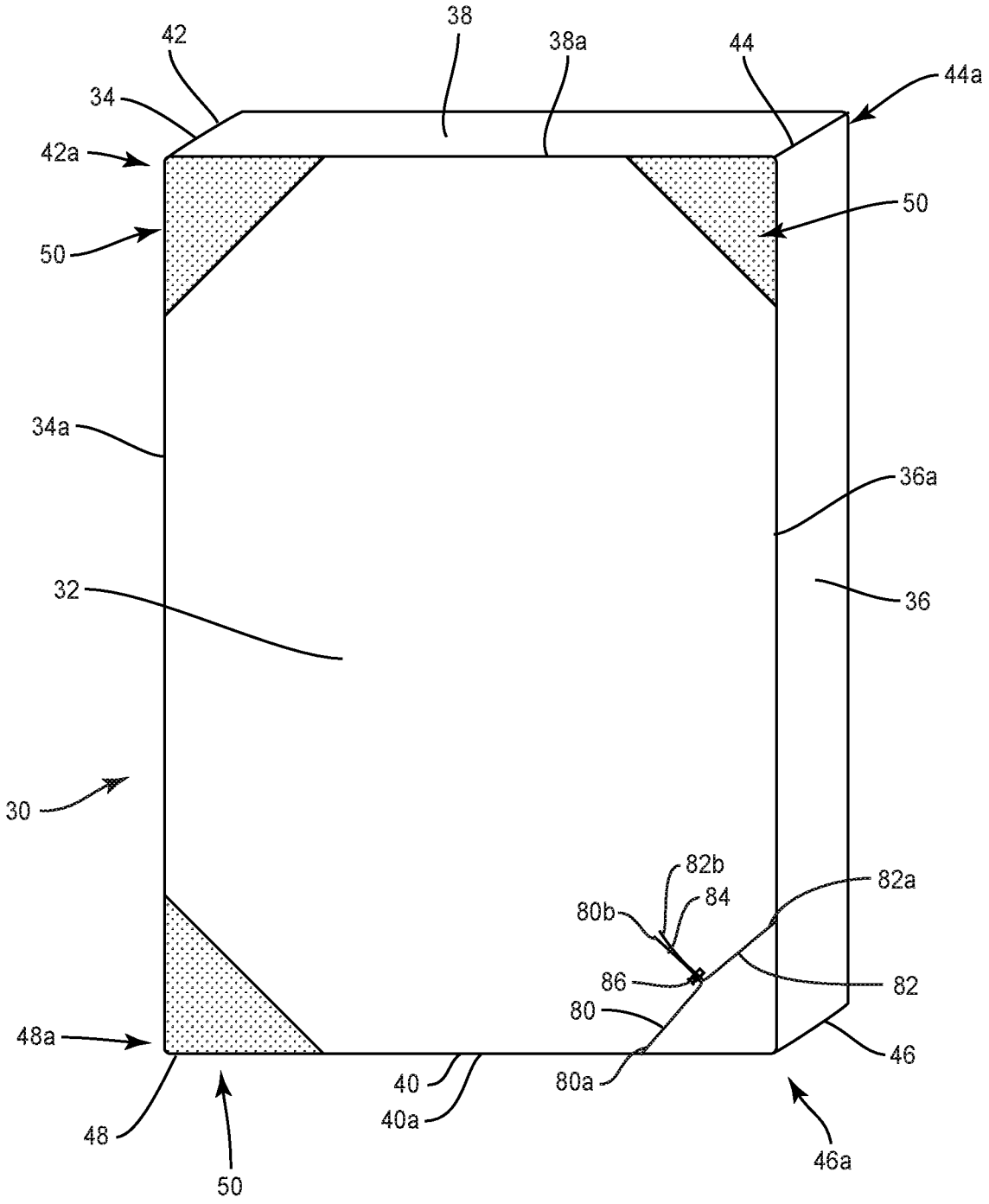
FIG. 12 is a bottom, perspective view of the bed sheet shown in FIG. 11.

In some embodiments, at least one of corners 42*a*, 44*a*, 46*a*, 48*a* includes a power band 50 and at least one of corners 42*a*, 44*a*, 46*a*, 48*a* includes a drawstring comprising a cord, such as, for example, a string 80 and cord, such as, for example, a string 82, as shown in FIG. 11. In some embodiments, three of corners 42*a*, 44*a*, 46*a*, 48*a* include a power band 50 and the other one of corners 42*a*, 44*a*, 46*a*, 48*a* includes strings 80, 82. Strings 80, 82 are spaced apart from seams 42, 44, 46, 48. In particular, strips strings 80, 82 each extend from a portion of one of edges 34*a*, 36*a*, 38*a*, 40*a* that is spaced apart from seams 42, 44, 46, 48. For example, in one embodiment, shown in FIG. 11, strings 80, 82 are positioned at corner 46*a*. An end 80*a* of string 82 engages a portion of edge 36*a* that is spaced apart from seam 46 and an end 80*a* of string 80 engages a portion of edge 40*a* that is spaced apart from seam 46. Ends 80*b*, 82*b* of strings 80, 82 are tied together in a knot 84. Strings 80, 82 include a clasp 86 between knot 84 and ends 80*a*, 82*a*. One embodiment of clasp 86 is shown in FIG. 11A. Clasp 86 includes a member 86*a* and a member 86*b* that is movably positioned within a cavity of member 86*a*. Clasp 86 includes a biasing member, such as, for example, a spring 86*c* positioned within the cavity in member 86*a*. Spring 86*c* is configured to move member 86*b* relative to member 86*a* between a first position in which an opening 86*d* of member 86*b* is coaxial with an opening 86*e* of member 86*a*, and a second position in which opening 86*d* is offset from opening 86*e*. Strings 80, 82 are positioned to extend through openings 86*d*, 86*e* such that strings 80, 82 are movable within openings 86*d*, 86*e* when member 86*b* is in the first position. Moving member 86*b* from the first position to the second position fixes strings 80, 82 relative to clasp 86 such that strings 80, 82 are fixed within openings 86*d*, 86*e* when member 86*b* is in the second position. In some embodiments, strings 80, 82 are wedged between an inner surface of member 80*b* that defines opening 80*d* and an inner surface of member 80*a* that defines opening 80*e* when member 80*b* is in the second position. Strings 80, 82 are movable from a first configuration in which knot 84 is spaced apart a first distance from clasp 86, as shown in FIG. 11, to a second configuration, shown in FIG. 12, in which knot 84 is spaced apart a second distance from clasp 86. As shown in FIGS. 11 and 12, moving strings 80, 82 from the first configuration to the second configuration reduces the amount of slack in strings 80, 82. In some embodiments, strings 80, 82 are maintained in the second configuration by moving member 86*b* from the first position to the second position.

In operation and use, bed sheet 30, such as, for example, bed sheet 30 shown in FIGS. 11 and 12, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strings 80, 82 are then positioned about the fourth corner of the mattress. For example, in one embodiment, panel 32 is positioned on top of the top surface of the mattress. Power bands 50 in corners 42*a*, 44*a* are positioned about top left and right corners of the mattress such that the power bands 50 in corners 42*a*, 44*a* engage the bottom surface of the mattress. The power band 50 in corner 48*a* is then positioned about the bottom right corner of the mattress such that the power band 50 in corner 48*a* engages the bottom surface of the mattress. Corner 46*a* is positioned over the bottom left corner of the mattress. Strings 80, 82 are then moved from the first configuration discussed above to the second configuration discussed above such that bed sheet 30 is secured to the mattress. Member 86*b* may be moved from the first position to the second position to maintain strings 80, 82 in the second configuration. Bed sheet 30 may be removed from the mattress by moving member 86*b* from the second position to the first position and then moving strings 80, 82 from the second configuration to the first configuration.

Corners 42*a*, 44*a*, 46*a*, 48*a* may then be removed from the mattress one corner at a time.

Figure 13:
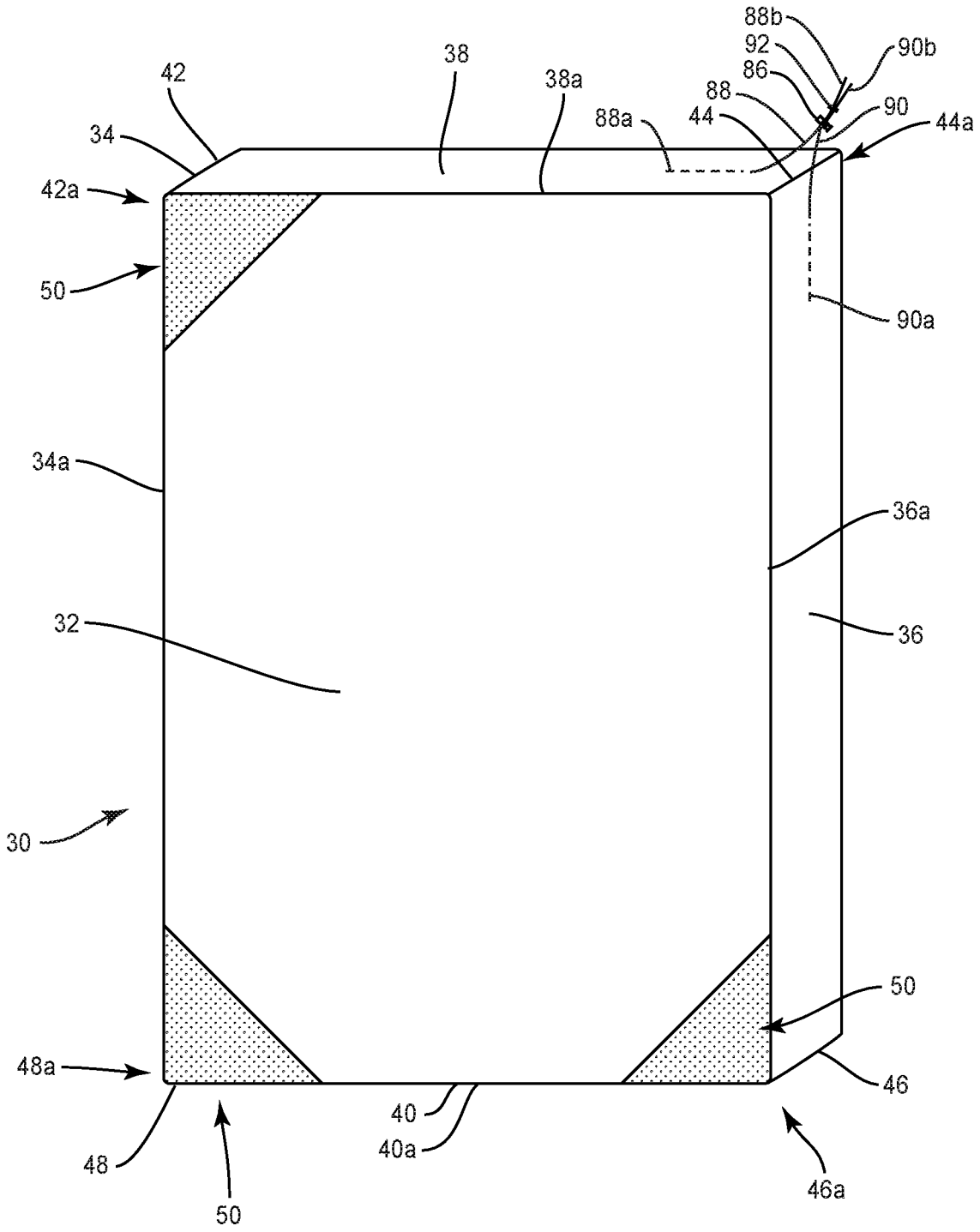
FIG. 13 is a bottom, perspective view of a bed sheet in accordance with the principles of the present disclosure.
Figure 14:
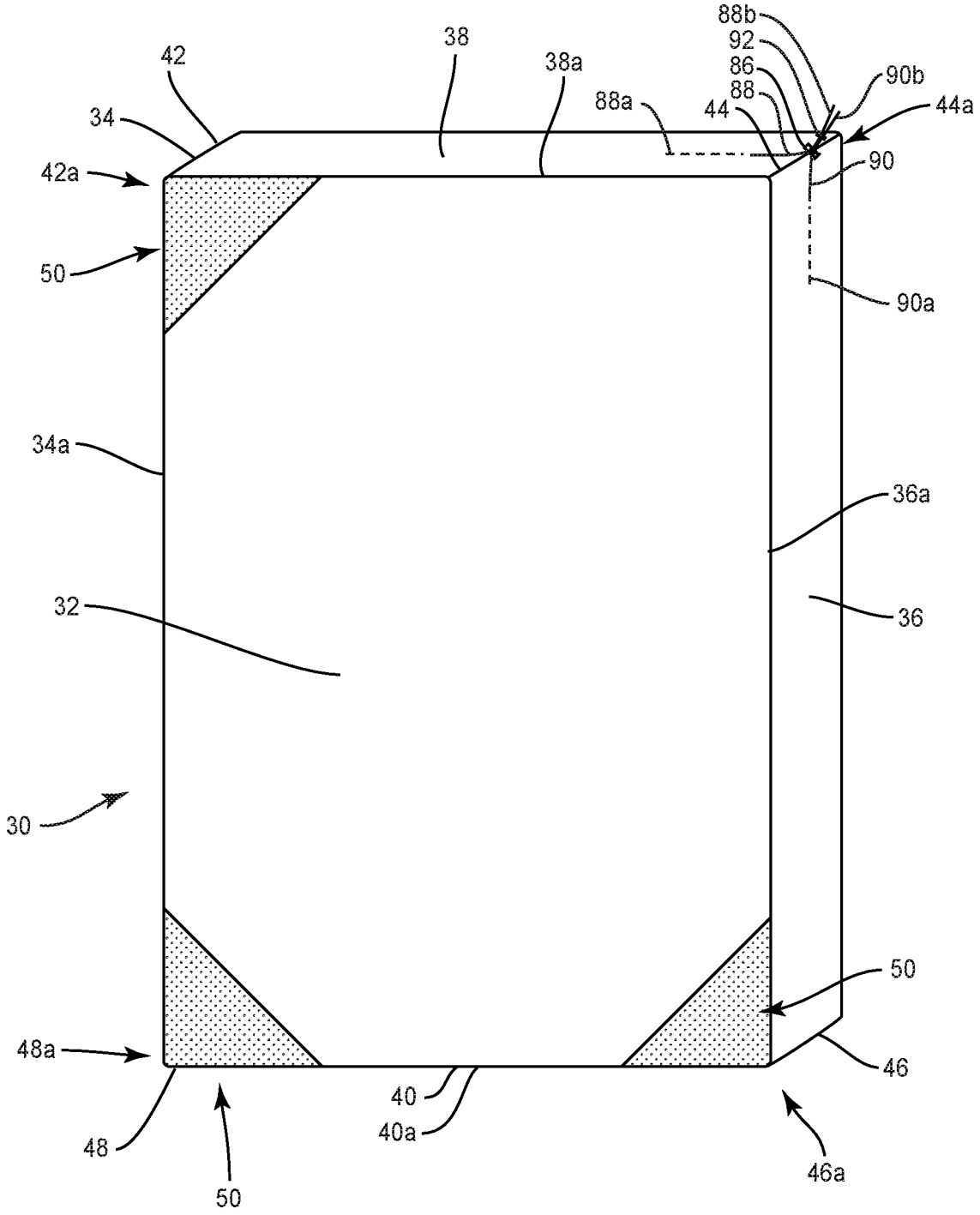
FIG. 14 is a bottom, perspective view of the bed sheet shown in FIG. 13.

In some embodiments, at least one of corners 42*a*, 44*a*, 46*a*, 48*a* includes a power band 50 and at least one of corners 42*a*, 44*a*, 46*a*, 48*a* includes a drawstring comprising a cord, such as, for example, a string 88 and cord, such as, for example, a string 90, as shown in FIG. 13. In some embodiments, three of corners 42*a*, 44*a*, 46*a*, 48*a* include a power band 50 and the other one of corners 42*a*, 44*a*, 46*a*, 48*a* includes strings 88, 90. Strings 88, 90 are each positioned in one of panels 34, 36, 38, 40 between panel 32 and one of lower edges 34*a*, 36*a*, 38*a*, 40*a*. For example, in one embodiment, shown in FIG. 13, strings 88, 90 are positioned at corner 44*a*. An end 88*a* of string 88 is fixed to panel 38 and an end 90*a* of string 90 is fixed to panel 36. In some embodiments, ends 88*a*, 90*a* are positioned within pockets in panels 36, 38. In some embodiments, ends 88*a*, 90*a* are fixed to panels 36, 38 by sewing ends 88*a*, 90*a* to panels 36, 38. Ends 88*b*, 90*b* of strings 88, 90 are tied together in a knot 92. Strings 88, 90 include clasp 86 between knot 92 and ends 88*a*, 90*a*. Strings 88, 90 are positioned to extend through openings 86*d*, 86*e* such that strings 88, 90 are movable within openings 86*d*, 86*e* when member 86*b* is in the first position. Moving member 86*b* from the first position to the second position fixes strings 88, 90 relative to clasp 86 such that strings 88, 90 are fixed within openings 86*d*, 86*e* when member 86*b* is in the second position. In some embodiments, strings 88, 90 are wedged between an inner surface of member 80*b* that defines opening 80*d* and an inner surface of member 80*a* that defines opening 80*e* when member 80*b* is in the second position. Strings 88, 90 are movable from a first configuration in which knot 92 is spaced apart a first distance from clasp 86, as shown in FIG. 13, to a second configuration, shown in FIG. 14, in which knot 92 is spaced apart a second distance from clasp 86. As shown in FIGS. 13 and 14, moving strings 88, 90 from the first configuration to the second configuration reduces the amount of slack in strings 88, 90. In some embodiments, strings 88, 90 are maintained in the second configuration by moving member 86*b* from the first position to the second position.

In operation and use, bed sheet 30, such as, for example, bed sheet 30 shown in FIGS. 13 and 14, may be secured to the mattress by positioning two of power bands 50 at two of corners 42*a*, 44*a*, 46*a*, 48*a* about two corners of the mattress. A third one of power bands 50 is then positioned over one of the other corners of the mattress as discussed herein. Strings 88, 90 are then positioned about the fourth corner of the mattress. For example, in one embodiment, panel 32 is positioned on top of the top surface of the mattress. Power bands 50 in corners 46*a*, 48*a* are positioned about top left and right corners of the mattress such that the power bands 50 in corners 46*a*, 48*a* engage the bottom surface of the mattress. The power band 50 in corner 42*a* is then positioned about the bottom right corner of the mattress such that the power band 50 in corner 42*a* engages the bottom surface of the mattress. Corner 44*a* is positioned over the bottom left corner of the mattress. Strings 88, 90 are then moved from the first configuration discussed above to the second configuration discussed above such that bed sheet 30 is secured to the mattress. Member 86*b* may be moved from the first position to the second position to maintain strings 88, 90 in the second configuration. Bed sheet 30 may be removed from the mattress by moving member 86*b* from the second position to the first position and then moving strings 88, 90 from the second configuration to the first configuration. Corners 42*a*, 44*a*, 46*a*, 48*a* may then be removed from the mattress one corner at a time.

Figure 15:
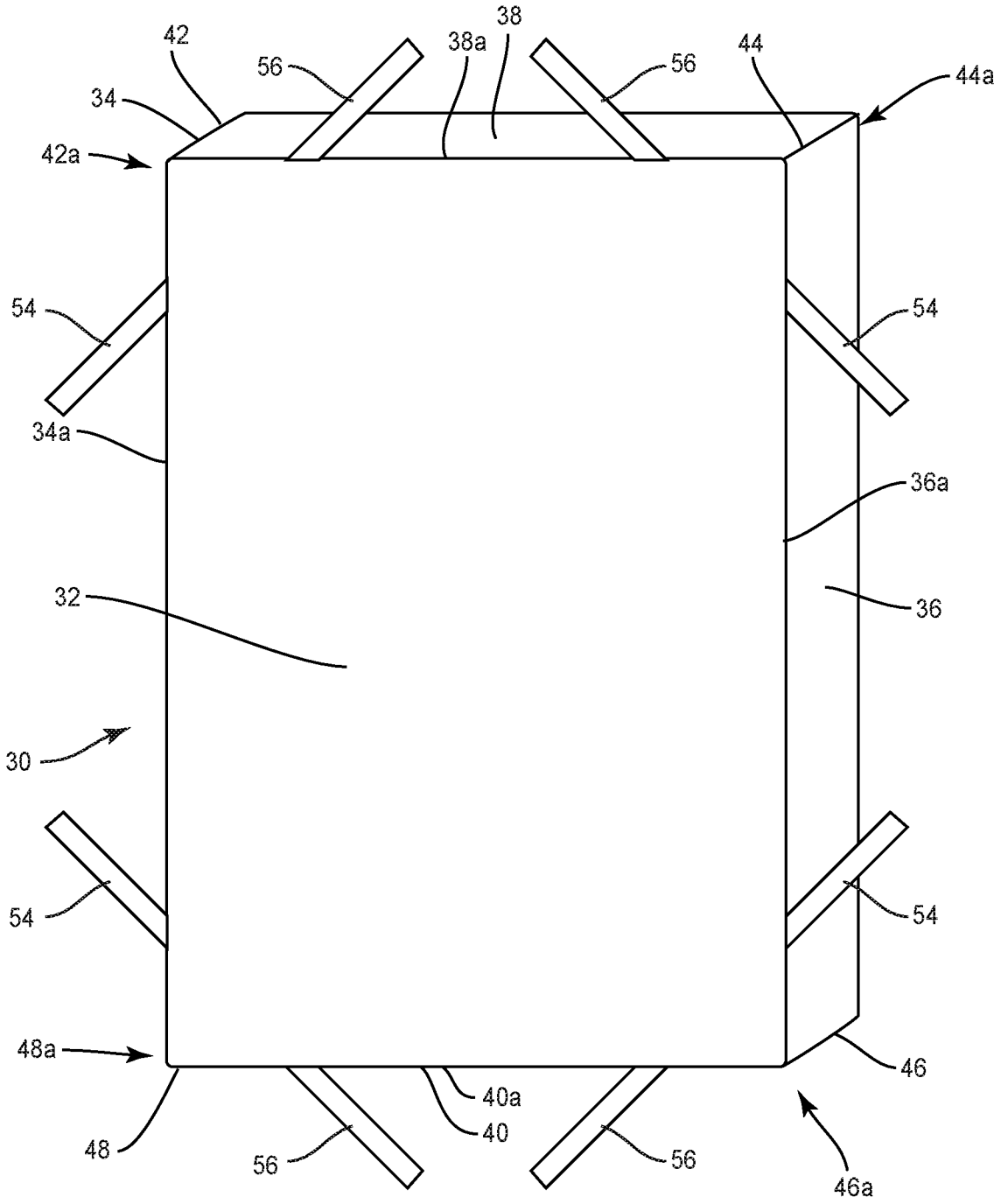
FIG. 15 is a bottom, perspective view of a bed sheet in accordance with the principles of the present disclosure.
Figure 16:
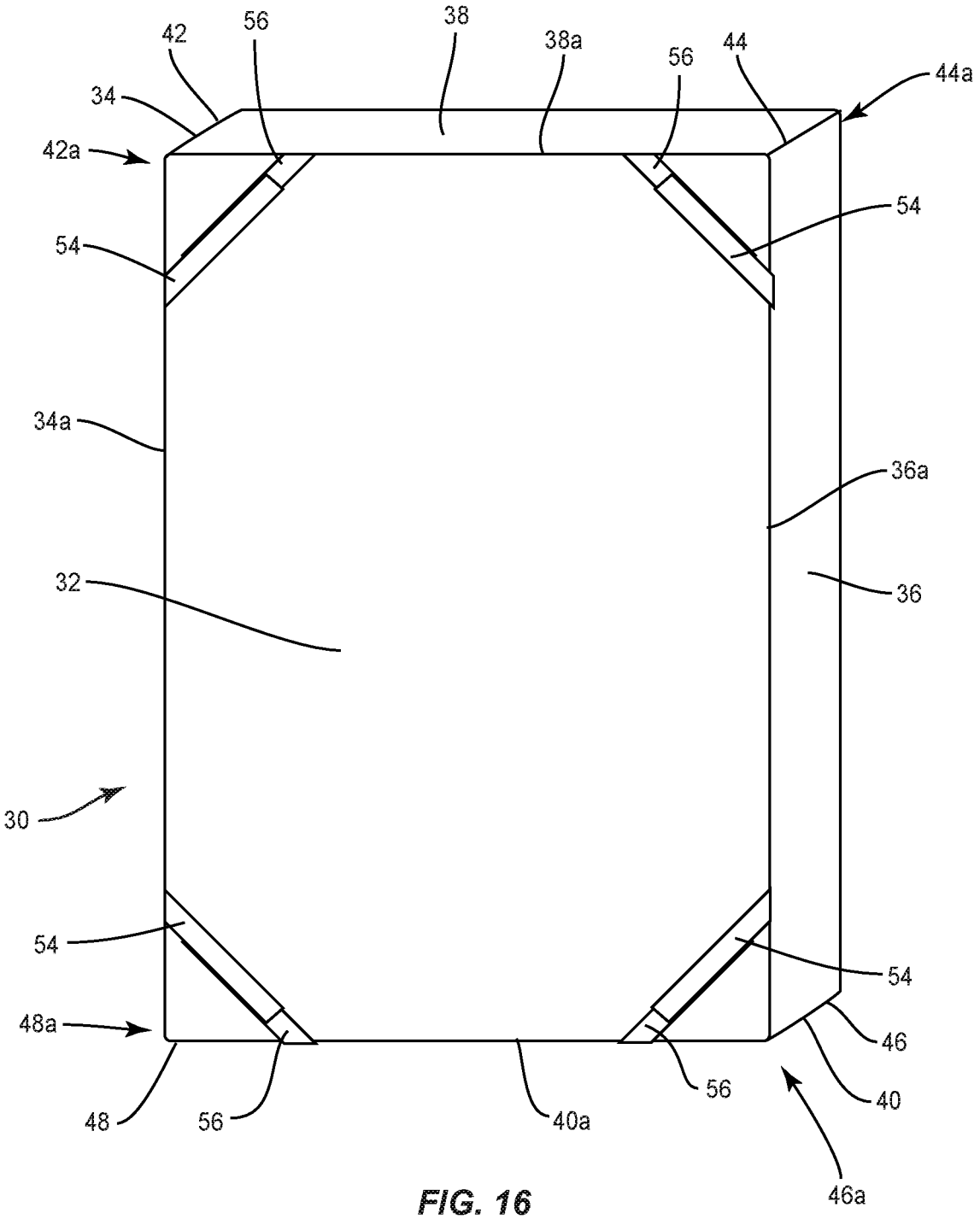
FIG. 16 is a bottom, perspective view of the bed sheet shown in FIG. 15.

In some embodiments, each of corners 42*a*, 44*a*, 46*a*, 48*a* includes strips 54, 56, shown in FIGS. 15 and 16. In operation and use, bed sheet 30 may be secured to the mattress by positioning corner 42*a* about the top right corner of the mattress, positioning corner 44*a* about the top left corner of the mattress, positioning corner 46*a* about the bottom left corner of the mattress, and positioning corner 48*a* about the bottom right corner of the mattress. Each pair of strips 54, 56 is then moved from the first configuration discussed above to the second configuration discussed above such that each pair of strips 54, 56 is positioned under one of the corners of the mattress with each pair of strips 54, 56 fixed relative to one another to secure bed sheet 30 to the mattress. Bed sheet 30 may be removed from the mattress by applying a force to each of strips 54, 56 in a particular direction sufficient to remove the loop fasteners from the hook fasteners. Corners 42*a*, 44*a*, 46*a*, 48*a* may then be removed from the mattress one corner at a time.

In some embodiments, bed sheet 30 (e.g., panels 32, 34, 36, 38, 40) includes various fabrics that are configured to allow moisture and warm air from a sleeper's body to dissipate away from the sleeper, thus preventing the warm air from circulating back to the sleep surface. At the same time, ambient air from the external environment may pass through bed sheet 30 to the sleeper. In some embodiments, bed sheet 30 comprises an inelastic material. In some embodiments, bed sheet 30 comprises a performance fabric. In some embodiments, the performance fabric is warp knitted. In some embodiments, the performance fabric is warp knitted and includes many yarns that are knit to together, as opposed to one yarn knit to the end. In some embodiments, the performance fabric is produced by circular knitting. In some embodiments, the circular knitting process includes circularly knitting yarn or other material into a fabric, such as, for example, a performance fabric. Circular knitting may include organizing knitting needles into a circular knitting bed. The knitting needles produce a circular fabric that is in a tubular form through the center of the cylinder.

In some embodiments, the circular knitted performance fabric is a 100% polyester knit jersey cotton fabric. In some embodiments, the circular knitted performance fabric that makes up portion 42 includes a single layer. In some embodiments, the circular knitted performance fabric includes a plurality of layers. In some embodiments, the circular knitted performance fabric that makes up portion 42 includes three layers, such as, for example, a top layer, a bottom layer and a middle layer between the top and bottom layers. In some embodiments, the bottom layer is a flat layer. In some embodiments, the bottom layer is a flat layer that contains more than 500 yarns. In some embodiments, the middle layer is a kind of filling that links the top and bottom layers. In some embodiments, the top layer is less dense than the bottom layer. In some embodiments, the top layer includes less yarns than the bottom layer. In some embodiments, the top layer has about 375 yarns. In some embodiments, the circular knitted performance fabric comprises a material selected from a group consisting of acrylic, acetate, cotton, linen, silk, polyester, other polymers, wool, nylon, rayon, spandex, lycra, hemp, manmade materials, natural materials and blends or combinations thereof.

In some embodiments, bed sheet is made from a performance fabric that allows heat and moisture that radiates from the sleeper's body to dissipate through the fitted bed sheet. In some embodiments, the performance fabric is a knitted fabric, including, but not limited to, a warp knitted performance fabric, a weft knitted performance fabric and a circular knitted performance fabric. In some embodiments, the performance fabric is a circular knitted performance fabric having a plurality of spaced apart ventilation ports. The circular knitted performance fabric has a gauge per square inch, grams per square meter, air permeability and material content that are pre-selected to provide the circular knitted performance fabric with one or more selected physical features. In some embodiments, the material is one or more of the materials discussed in U.S. patent application Ser. No. 15/141,223, which is incorporated herein by reference, in its entirety.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bed covering comprising:

top, side and end panels, the side and end panels each having a lower edge that is spaced apart from the top panel, at least one of the panels comprising a circular knit performance fabric having a top layer, a bottom layer and a middle layer between the top layer and the bottom layer, the top layer comprising more than 50 ventilation ports per square inch such that the top layer is less dense than the bottom layer, interfaces between the side panels and the end panels defining corners of the covering, the side and end panels including inner surfaces and opposite outer surfaces, the inner surfaces defining a cavity, wherein the covering includes a strip that extends from a portion of the lower edge of one of the end panels to a portion of the lower edge of one of the side panels such that the strip is spaced apart from the corners.

2. A bed covering as recited in claim 1, wherein the middle layer links the top layer to the bottom layer.

3. A bed covering as recited in claim 1, wherein a first end of the strip directly engages the portion of the lower edge of the one of the end panels and an opposite second end of the strip directly engages the portion of the lower edge of the one of the side panels, the second end being permanently fixed to the lower edge of the one of the side panels.

4. A bed covering as recited in claim 1, wherein the top panel is made from a the circular knit performance fabric and at least one of the side panels and the end panels is made from a second fabric, the second fabric being different than the circular knit performance fabric.

5. A bed covering as recited in claim 1, wherein top panel is made from the circular knit performance fabric and the side panels and the end panels are each made from a second fabric, the second fabric being different than the first circular knit performance fabric.

6. A bed covering as recited in claim 1, wherein the side panels include a first side panel and an opposite second panel, the end panels including a first end panel and an opposite second end panel, the strip being a first strip extending from the first end panel to the first side panel, the covering comprising a second strip that extends from a portion of the lower edge of the first end panel to a portion of the lower edge of the second side panel.

7. A bed covering as recited in claim 1, wherein the side panels include a first side panel and an opposite second panel, the end panels including a first end panel and an opposite second end panel, the strip being a first strip extending from the first end panel to the first side panel, the covering comprising a second strip that extends from a portion of the lower edge of the second end panel to a portion of the lower edge of the first side panel such that the second strip is spaced apart from the corners.

8. A bed covering as recited in claim 1, wherein the top, side and end panels each comprise a first material and the strip comprises a second material that is different than the first material.

9. A bed covering as recited in claim 8, wherein the second material is an elastic material.

10. A bed covering as recited in claim 8, wherein the first material is an inelastic material and the second material is an elastic material.

11. A bed covering as recited in claim 1, wherein the side panels include a first side panel and an opposite second panel, the end panels including a first end panel and an opposite second end panel, the strip being a first strip extending from the first end panel to the first side panel, the covering comprising a second strip that extends from a portion of the lower edge of the second end panel to a portion of the lower edge of the second side panel such that the second strip is spaced apart from the corners.

12. A bed covering as recited in claim 1, wherein the side panels include a first side panel and an opposite second panel, the end panels including a first end panel and an opposite second end panel, the strip being a first strip extending from the first end panel to the first side panel, the covering comprising a second strip that extends from a portion of the lower edge of the first end panel to a portion of the lower edge of the second side panel such that the second strip is spaced apart from the corners, the covering comprising a third strip that extends from a portion of the lower edge of the second end panel to a portion of the lower edge of the first side panel such that the third strip is spaced apart from the corners, the covering comprising a fourth strip that extends from a portion of the lower edge of the second end panel to a portion of the lower edge of the second side panel such that the fourth strip is spaced apart from the corners.

13. A bed covering as recited in claim 12, wherein the first side panel extends parallel to the second side panel and the first end panel extends parallel to the second end panel.

14. A bed covering as recited in claim 1, wherein the side panels and the end panels each comprise an elastic material.

15. A bed covering as recited in claim 1, wherein adjacent ends of the side and end panels are joined to form a seam at each of the corners, the strip being spaced apart from the seams.

16. A bed covering comprising:

top, side and end panels, adjacent ends of the side and end panels being joined to form a seam at a corner of the covering, the side and end panels each having a lower edge that is spaced apart from the top panel, outer portions of the lower edges defining a maximum perimeter of the bed covering, the covering comprising a strip that extends from the lower edge of one of the end panels to the lower edge of one of the side panels such that the strip is spaced apart from the seams, wherein at least one of the panels comprises a circular knit performance fabric, the fabric having a top layer comprising a first material, a bottom layer comprising a second material and a middle layer between the top layer and the bottom layer, the middle layer comprising a third material, the first material being less dense than the second material and the third material, the top layer comprising more than 50 ventilation ports per inch.

17. A bed covering as recited in claim 16, wherein the side and end panels each have a uniform thickness from the top panel to the lower edge of a respective one of the side and end panels.

18. A bed covering as recited in claim 16, wherein the side and end panels each comprise an elastic material.

19. A bed covering as recited in claim 16, wherein the layers are configured to allow heat and moisture that radiates from a sleeper to dissipate through the layers.

20. A bed covering comprising:

a top panel, opposite first and second side panels and opposite first and second end panels, adjacent ends of the side and end panels being joined to form a seam at a corner of the covering, the side and end panels each having a lower edge that is spaced apart from the top panel, outer portions of the lower edges defining a maximum perimeter of the bed covering, the covering including a first strip that extends from the lower edge of the first end panel to the lower edge of the first side panel, the covering comprising a second strip that extends from a portion of the lower edge of the first end panel to a portion of the lower edge of the second side panel, the covering comprising a third strip that extends from a portion of the lower edge of the second end panel to a portion of the lower edge of the first side panel, the covering comprising a fourth strip that extends from a portion of the lower edge of the second end panel to a portion of the lower edge of the second side panel, wherein at least one of the panels comprises a circular knit performance fabric having a top layer, a bottom layer and a middle layer between the top layer and the bottom layer, the top layer being less dense than the bottom layer, the top layer having more than 50 ventilation ports per inch, wherein the strips are each spaced apart from the corners, wherein the side and end panels each comprise an inelastic material, and wherein the strips each comprise an elastic material.

21. A bed covering as recited in claim 20, wherein the top layer is less dense than the middle layer.

22. A bed covering as recited in claim 20, wherein the top layer comprises a first material, the bottom layer comprises a second material and the middle layer comprises a third material, the first, second and third materials each being permeable.

* * * * *